US009985373B2

(12) United States Patent
Chen

(10) Patent No.: US 9,985,373 B2
(45) Date of Patent: May 29, 2018

(54) COMMUNICATION CONNECTOR

(71) Applicant: Surtec Industries, Inc., Keelung (TW)

(72) Inventor: Chou-Hsin Chen, Keelung (TW)

(73) Assignee: Surtec Industries, Inc., Keelung (TW)

( * ) Notice: Subject to any disclaimer, the term of this patent is extended or adjusted under 35 U.S.C. 154(b) by 0 days. days.

(21) Appl. No.: 15/291,580

(22) Filed: Oct. 12, 2016

(65) Prior Publication Data

US 2018/0102602 A1 Apr. 12, 2018

(51) Int. Cl.

| | |
|---|---|
| ***H01R 24/00*** | (2011.01) |
| ***H01R 13/17*** | (2006.01) |
| ***H01R 24/64*** | (2011.01) |
| ***H01R 4/24*** | (2018.01) |
| ***H01R 12/58*** | (2011.01) |
| *H01R 107/00* | (2006.01) |

(52) U.S. Cl.
CPC ..... *H01R 13/17* (2013.01); *H01R 4/2416* (2013.01); *H01R 12/585* (2013.01); *H01R 24/64* (2013.01); *H01R 2107/00* (2013.01)

(58) Field of Classification Search
CPC ..... H01R 13/17
USPC ..... 439/676
See application file for complete search history.

(56) References Cited

U.S. PATENT DOCUMENTS 6,354,891 B1 * 3/2002 Schnell ..... G06K 7/0021 439/630
6,358,093 B1 * 3/2002 Phommachanh ..... H01R 24/64 439/188
6,443,777 B1 * 9/2002 McCurdy ..... H01R 13/6461 439/676
7,367,849 B2 * 5/2008 Wang ..... H01R 13/6466 439/676
7,422,493 B2 * 9/2008 Wang ..... H01R 13/41 439/862
7,481,678 B2 * 1/2009 Aekins ..... H01R 13/7033 439/620.11
7,618,296 B2 * 11/2009 Caveney ..... H01R 13/6658 439/676
7,658,648 B2 * 2/2010 Aekins ..... H01R 13/7033 439/620.11
7,726,018 B2 * 6/2010 Caveney ..... H05K 1/0228 29/872
7,909,657 B1 * 3/2011 Abughazaleh ..... H05K 1/18 439/676

(Continued)

*Primary Examiner* — Tulsidas C Patel
*Assistant Examiner* — Peter G Leigh
(74) *Attorney, Agent, or Firm* — McGlew and Tuttle, P.C.

(57) ABSTRACT

A communication connector includes a housing defining a plug receiving space with a circuit board arrangement supported by the housing, which has pairs of communication paths associated with a plurality of contact pads. A spring contact arrangement includes a support/guide and a spring contacts. Each spring contact has a supported/guided portion, an extending end, an intervening pad contact portion contacting a pad, between the supported/guided portion and the extending end, a spring arm portion between the supported/guided portion and the pad contact portion and having a contact portion, with a plug contact surface, between the pad contact portion and the extending end. The plug contact surface is positioned in the plug receiving space in an unmated state. In plug mated state a deflection of the contact portion causes a relative deflection of the spring arm portion.

17 Claims, 49 Drawing Sheets

(56) References Cited

U.S. PATENT DOCUMENTS 7,927,152 B2 * 4/2011 Pepe ..... H01R 24/64 439/676
8,133,069 B2 * 3/2012 Hogue ..... H01R 13/6464 439/404
8,287,316 B2 * 10/2012 Pepe ..... H01R 13/02 439/676
8,435,082 B2 * 5/2013 Bopp ..... H01R 13/6466 439/676
8,496,501 B2 * 7/2013 Pepe ..... H01R 13/02 439/676
8,500,496 B2 * 8/2013 Bopp ..... H01R 13/6658 439/676
8,616,923 B2 * 12/2013 Bopp ..... H01R 13/6658 439/676
8,638,651 B2 * 1/2014 Michaelis ..... G01R 31/043 324/66
8,641,452 B2 * 2/2014 Patel ..... H01R 13/6466 439/620.23
8,758,060 B2 * 6/2014 Caveney ..... H01R 13/6658 439/620.22
8,931,167 B2 * 1/2015 Abughazaleh ..... H05K 1/18 29/842
8,944,855 B2 * 2/2015 Bolouri-Saransar H01R 13/6461 439/218
8,952,707 B2 * 2/2015 Hashim ..... G01R 31/043 324/647
8,979,578 B2 * 3/2015 Hogue ..... H01R 9/031 439/540.1
9,011,181 B2 * 4/2015 Caveney ..... H05K 1/0228 439/676
9,263,821 B2 * 2/2016 Pepe ..... H01R 13/02
9,281,632 B2 * 3/2016 Caveney ..... H01R 13/6658
9,419,391 B2 * 8/2016 Bolouri-Saransar ..... H01R 4/24
9,478,888 B2 * 10/2016 AbuGhazaleh ..... H05K 1/18
2006/0014410 A1 * 1/2006 Caveney ..... H01R 13/6658 439/188
2009/0186532 A1 * 7/2009 Goodrich ..... H01R 13/64 439/676
2012/0187964 A1 * 7/2012 Michaelis ..... G01R 31/043 324/679
2014/0273633 A1 * 9/2014 Gatnau Navarro .. H01R 13/665 439/620.01

* cited by examiner

COMMUNICATION CONNECTOR

FIELD OF THE INVENTION

The present invention relates to a communication connector and more particularly to a communication connector that provides a communication jack with excellent performance characteristics and which may be used with existing communication connector plugs.

BACKGROUND OF THE INVENTION

U.S. Pat. No. 7,367,849 discloses an electrical connector with a circuit board with interconnecting conductors respectively extending between spring contact termination locations and other termination locations. The spring contacts are provided as sets terminating at respective spring contact termination locations. Each of the spring contact conductors of the set of spring contact conductors has a plug contact zone and defines a spring contact conductive path from an associated plug contact zone to a respective spring contact termination location. The sets of spring contact conductors provide different conductive path lengths from an associated plug contact zone to a respective spring contact termination location. One of the sets of contacts have a shorter length and extend upwardly from the termination point at the circuit board and then extend rearwardly, at a different angle as compared to other contacts. The shortened length provides performance advantages. However, this may not be sufficient for the next generation Ethernet (40G or 100G). Further, a shortened length of the spring contacts affects the spring characteristics. This presents an inherent constraint as to a length of the spring contacts from an associated plug contact zone to a respective spring contact termination location.

SUMMARY OF THE INVENTION

An object of the invention is to provide a device and technique with a communication jack with an even shorter path along the spring contacts from a plug contact region to a compensation circuit of the communication jack.

It is a further object of the invention to provide a high performance RJ 45 socket design that meets the next generation Ethernet (40G or 100G) performance requirements and is simple in design, rugged in construction and economical to manufacture.

According to the invention the spring contact is divided into a contact portion and another supporting portion, the contact can have a very short contact length and transmission length, but the overall spring contact has good spring characteristics with a long flexible spring arm.

According to the invention, a communication connector jack is provided comprising a housing defining a plug receiving space a circuit board arrangement supported by the housing and a spring contact arrangement. The circuit board arrangement comprises a plurality of electrical circuits defining plural pairs of communication paths and a plurality of contact pads. Each of the contact pads is electrically connected to a respective one of the communication paths. The spring contact arrangement comprises a support/guide and a plurality of spring contacts. Each of the plurality of spring contacts has a supported/guided portion that is supported/guided by the support/guide and has an extending end, having an intervening pad contact portion, between the supported/guided portion and the extending end. Each pad contact portion is in electrical and physical contact with an associated one of the contact pads of the circuit board arrangement. A spring arm portion is provided between the supported/guided portion and the pad contact portion. A contact portion, with a plug contact surface, is provided between the pad contact portion and the extending end. The plug contact surface is positioned in the plug contact receiving space in an unmated state and, in a plug mated state, a deflection of the contact portion causes a relative deflection of the spring arm portion. Each contact spring advantageously undergoes a rocking motion with the contact spring pivoting against the associated contact pad with a transitioning from the unmated state to plug mated state.

The support/guide may be comprised by a first fitting portion and a second fitting portion. The supported/guided portion may extend between the first fitting portion and the second fitting portion and may be guided between the first fitting portion and the second fitting portion at a fitting spring contact guiding region. The first fitting portion may comprise an insert base and the second fitting portion may comprise an insert cover with slots. Each of the spring contacts may extend through one of the slots to position the extending ends and the pad contact portion on a plug receiving space side of the insert cover. The insert cover may include a retaining portion extending from the insert cover in a direction of the plug receiving space. The first fitting portion and the second fitting portion support the supported/guided portion with the pad contact portion in contact with one of the pads and with the extending end biased into contact with the retaining portion. Upon a plug being inserted into the plug receiving space, the extending end is moved, by a contact of the plug, relative to the retaining portion and against the spring bias.

The support/guide of the spring contact arrangement may further comprise a plurality of holder arrangements, each holder arrangement comprising a biasing spring with a non-conductive holder forming a portion of the spring contact guiding region, wherein each biasing spring is held between the first fitting portion and the second fitting portion to press an associated holder into contact with an associated supported/guided portion of one of the contact springs to form the guiding region between the non-conductive holder and a non-conductive portion of one of the first fitting portion and the second fitting portion. The contact spring and the biasing spring together provide combined spring arm characteristics divided into a contact portion and a non conductive supporting portion.

The plurality of spring contacts may comprise a first set of spring contacts having a first set supported/guided portion, a first set pad contact portion and a first set spring arm portion between the supported/guided portion and pad contact portion. Each first set spring arm portion and the first supported/guided portion extend essentially along a first angle of inclination relative to the first fitting portion and the second fitting portion. The plurality of spring contacts may comprise a second set of spring contacts having a second set supported/guided portion, a second set pad contact portion and a second set spring arm portion between the supported/guided portion and pad contact portion. Each second set spring arm portion and the second supported/guided portion extend essentially along a second angle of inclination relative to the first fitting portion and the second fitting portion and the first angle of inclination is different from the second angle of inclination and the contact springs are disposed one after another alternating between contact springs of the first set of contacts springs and contact springs of the second set of contacts springs, such that each spring arm portion is not parallel with an adjacent spring arm portion.

The housing may be formed of a plurality of housing parts. At least one of the first fitting portion and a second fitting portion may be formed in one piece with one of the housing parts.

A stiffness of the contact portion extending end and/or of the contact portion may be greater than a stiffness of the spring arm portion.

One of the first fitting portion and the second fitting portion may include a retaining bar to retain each spring contact in electrical and physical contact with an associated one of the contact pads.

The support/guide may be comprised by an insert molding of the supported/guided portions.

The communication connector may be a RJ45 socket with insulation displacement contacts (IDCs) electrically connected to a respective one of the communication paths.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
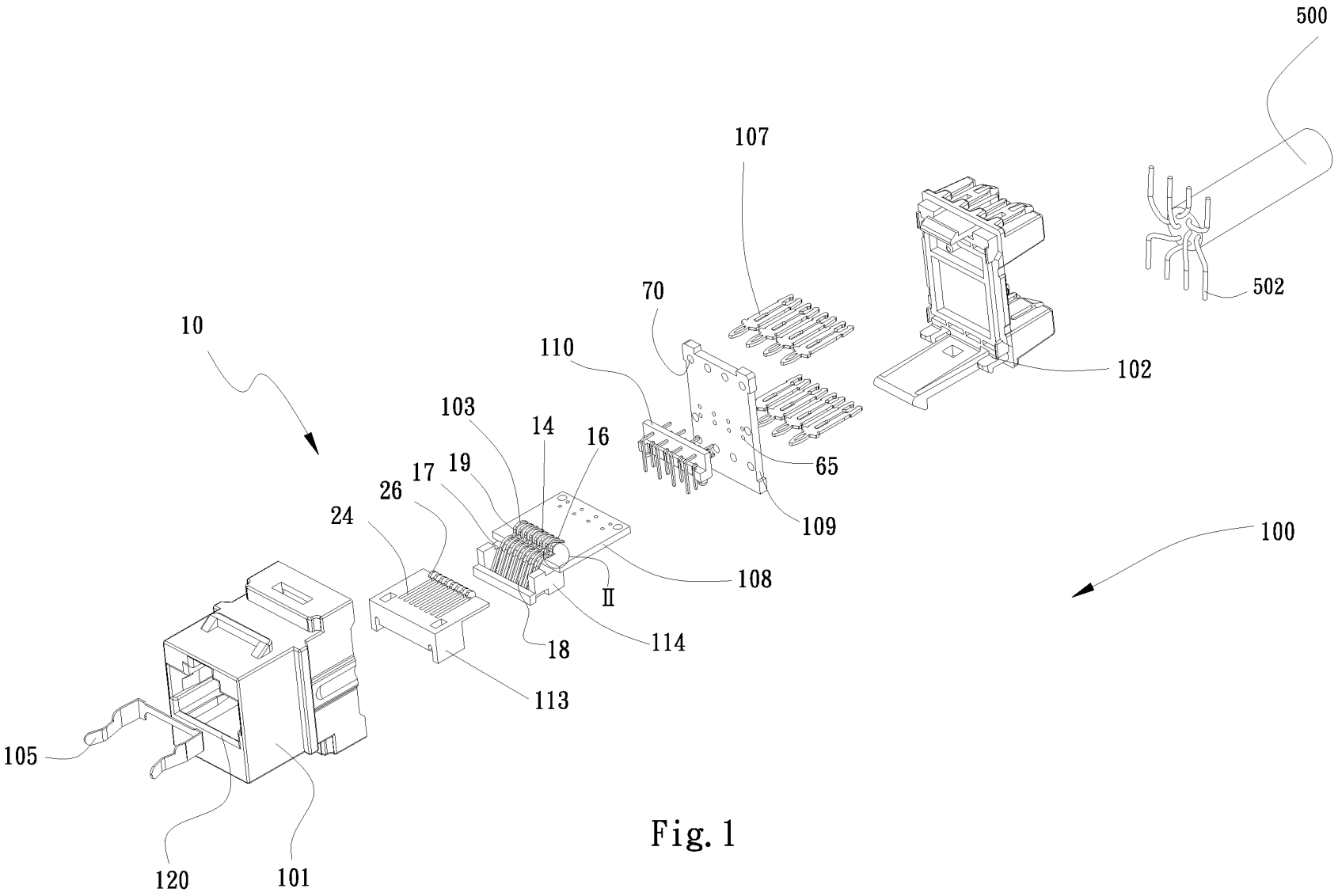
FIG. 1 is an exploded view of a communication jack according to an embodiment of the invention.

Referring to the drawings, FIGS. 1-7 show a first embodiment of a communication jack generally designated 100. The communication jack 100 comprises a jack housing part 101 and a seat housing part 102 that connect together to support an insert including a circuit arrangement. The jack housing part 101 and a seat housing part 102 define a plug receiving space 80 that is configured to receives a communication plug 200. The circuit arrangement of the communication jack 100 comprises circuit boards 108 and 109 and a pin head part 110, that connects the circuit boards 108 and 109. The circuit board 108 cooperates with spring contacts 103 to pass signals to and from a connected communication plug 200. The features of the communications plug 200 are particularly shown in FIGS. 5A and 5B. The communications plug 200 supports plug contacts 203. The plug contacts 203 are connected to individual wires of a cable. The connection between the wires and the plug contacts 203 may be via a circuit board 204 that provides signal paths from the wires of the cable to the respective contacts 203.

The spring contacts 103 are part of a spring contact arrangement (spring contact guiding, supporting and retaining arrangement) generally designated 10. The spring contact arrangement 10 positions a plug contact surface 14 of each of the spring contacts 103 in the plug receiving space 80 and also supports and guides a spring movement of each of the spring contacts 103 and retains each of the spring contacts 103. The spring contact arrangement 10 may be embodied by any combination of the housing parts and insert parts. According to the embodiment of FIGS. 1-7, the spring contact arrangement 10 comprises a first fitting portion 114 and a second fitting portion 113 of the insert.

Figure 2:
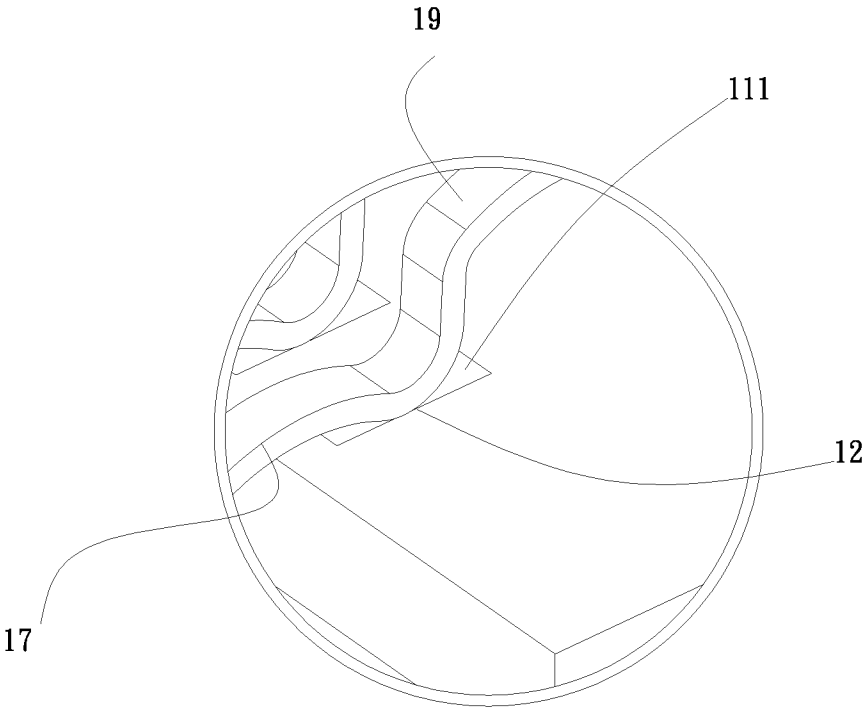
FIG. 2 is a detail view of detail II of FIG. 1.
Figure 5A:
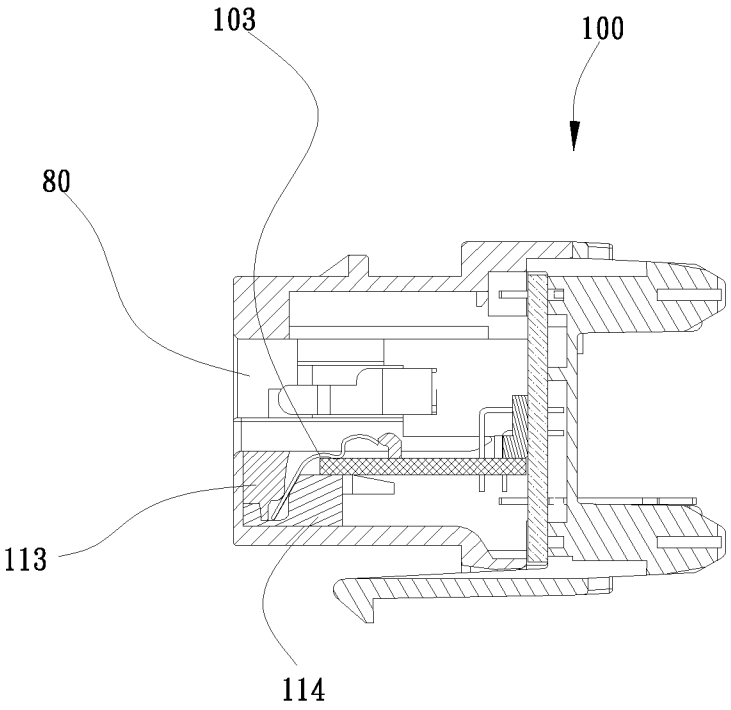
FIG. 5A is a side sectional view showing a communication plug aligned with the communication jack of FIG. 1, taken through a center thereof.
Figure 5A:
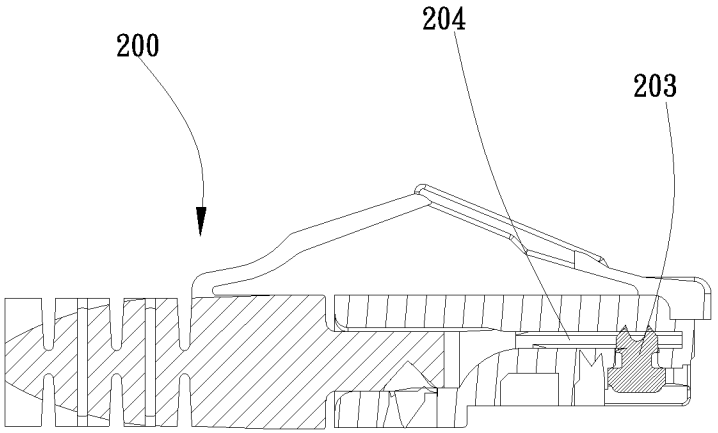
Figure 5B:
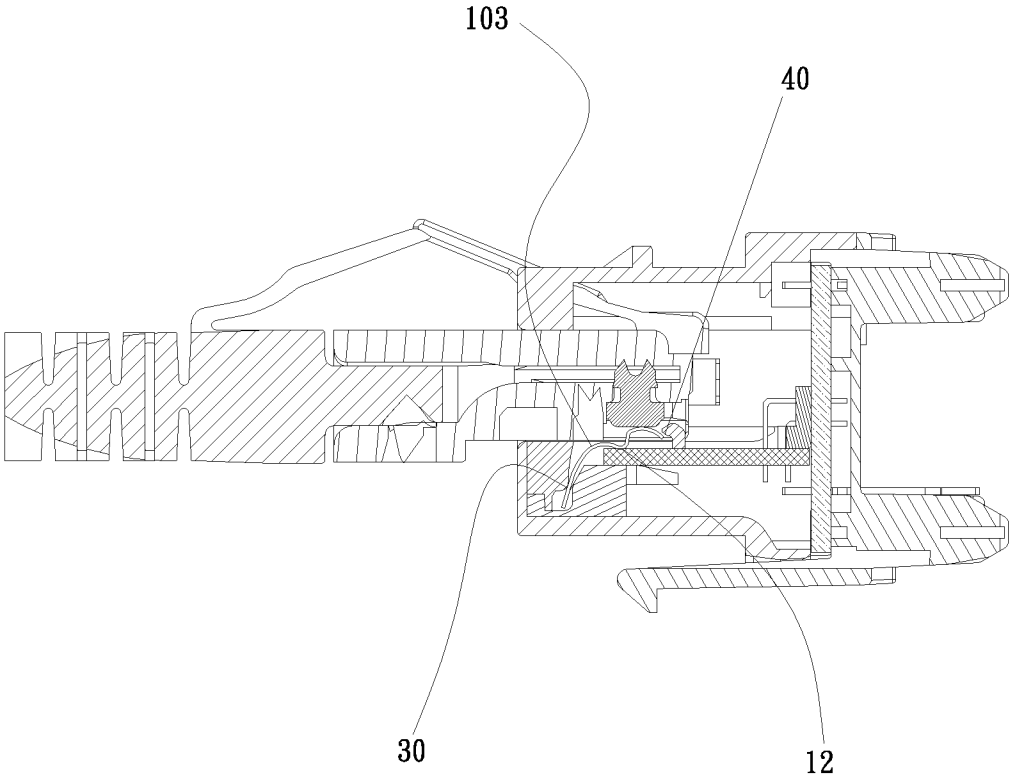
FIG. 5B is a side sectional view showing a communication plug mated with the communication jack of FIG. 1, taken through a center thereof.
Figure 6A:
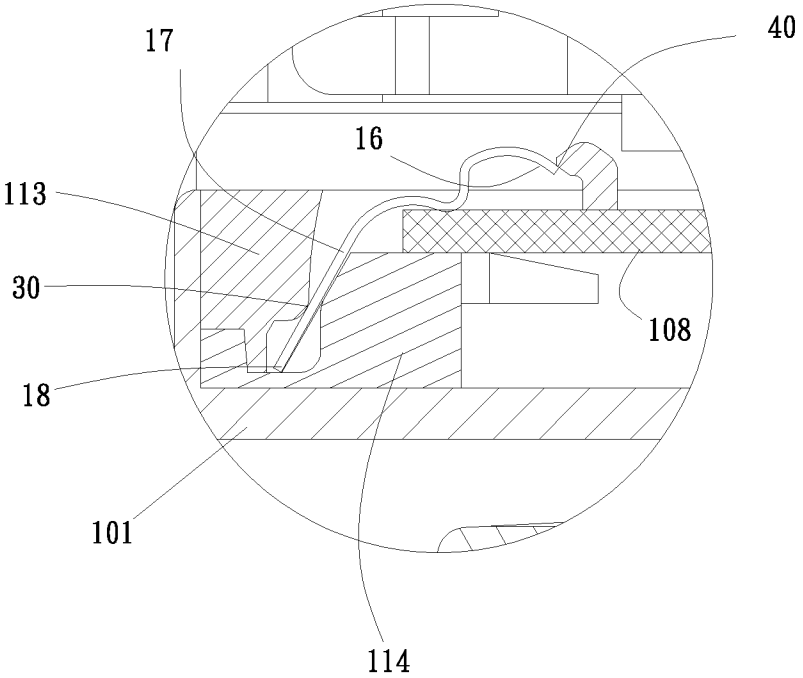
FIG. 6A is an enlarged side sectional view showing a portion of the plug receiving space, in an unmated state, of the communication jack of FIG. 1.
Figure 6B:
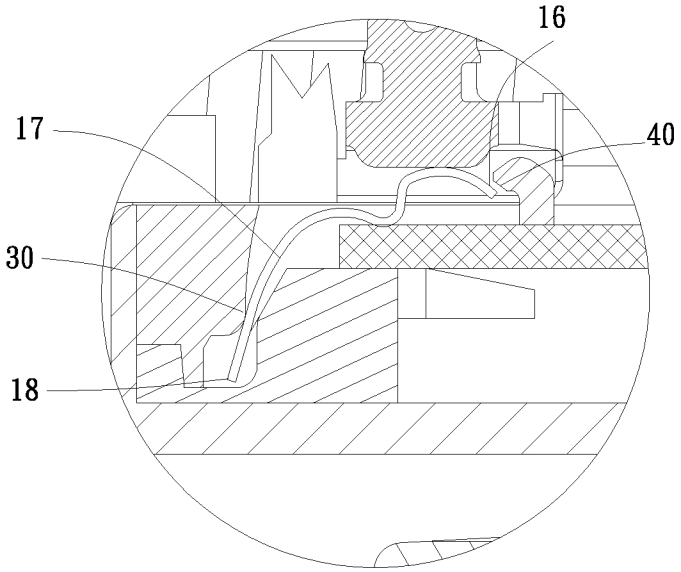
FIG. 6B is an enlarged side sectional view showing a portion of the plug receiving space, in a mated state, of the communication jack of FIG. 1.

Each spring contact 103 includes a pad contact portion 12, which, in an assembled state of the communication jack 100, is always in physical and electrical contact with an associated pad 111 of the circuit board 108 (FIG. 2). Each spring contact 103 also includes the plug contact surface 14, which engages a corresponding plug contact 203 when the plug 200 is mated with the communication jack 100 (FIG. 5B, 6B). Each spring contact 103 also includes a moveably supported extending end 16. Each spring contact 103 also includes a supported/guided end portion 18. As can best be seen in FIGS. 6 and 7, the supported/guided end portion 18 is held at a support and guide region 30 between the first fitting portion 114 and the second fitting portion 113. This provides support and a sliding guide for the supported/guided end portion 18 at the support and guide region 30. With this construction, each spring contact 103 has a spring arm portion 17. The spring arm portion 17 extends from the support and guide region 30 to the pad contact portion 12. A contact portion 19 extends from the pad contact portion 12 to the plug contact surface 14. The contact portion 19 provides the transmission path between the plug contact 203 of the plug 200 and the pads 111 of the circuit board 108. The spring contact 103 extends from the plug contact surface 14 to the supported extending end 16. The supported extending end 16 is retained by a retaining surface 40 of a retaining portion 26. The retaining surface 40 acts as a stop to prevent the spring force of the spring contact 103 from moving the end further into a plug receiving space 80 of the communication jack 100. The configuration of the spring contact arrangement 10, with the support and guide region 30 and retaining surface 40, positions and retains each contact spring 103. Each pad contact portion 12 is maintained in contact with an associated pad 111 of the circuit board 108. The plug contact surface is positioned in the plug contact receiving space in an unmated state (FIG. 5A, 6A). In plug mated state (FIG. 5B, 6B) a deflection of the contact portion causes a relative deflection of the spring arm portion 17 with the supported/guided end portion 18 guided by the support and guide region 30. Each contact spring 103 is guided and retained with the spring contact arrangement 10 so as to undergo a rocking motion with the contact spring 103 pivoting against the associated contact pad 111 with a transitioning from the unmated state (FIG. 6A) to plug mated state (FIG. 6B).

Figure 7:
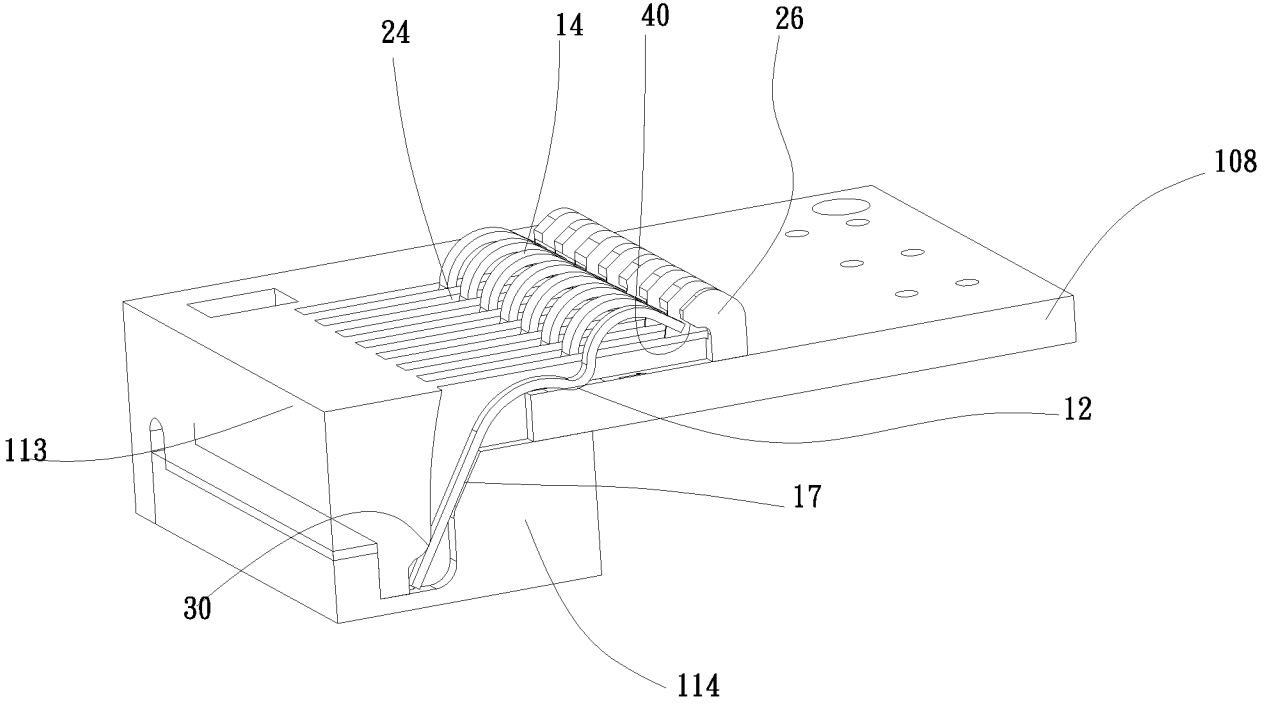
FIG. 7 is a side perspective sectional view showing a subassembly with a first fitting portion, a second fitting portion, spring contacts and circuit board with pads of the communication jack of FIG. 6.
Figure 8:
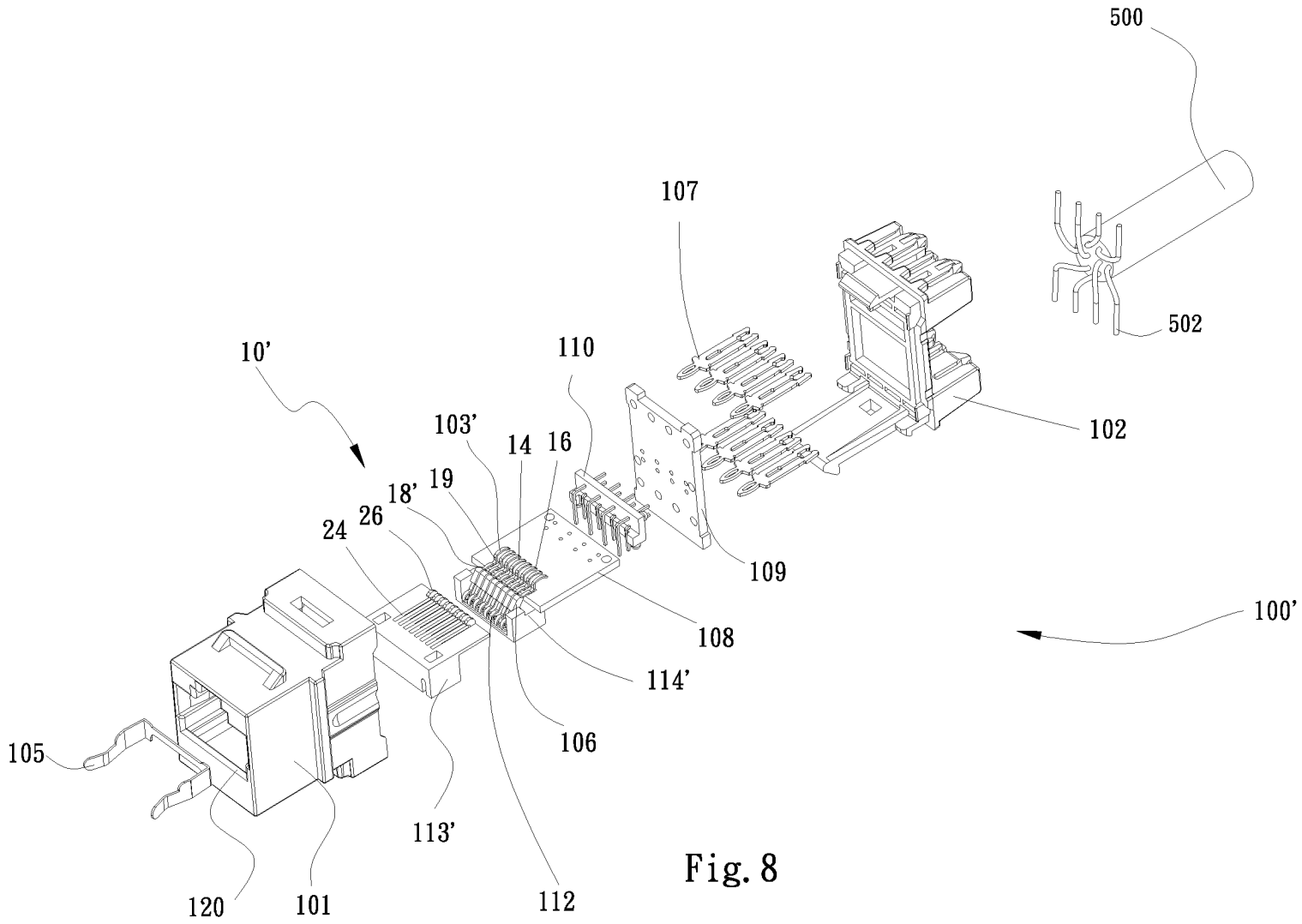
FIG. 8 is an exploded view of a communication jack according to another embodiment of the invention.
Figure 9A:
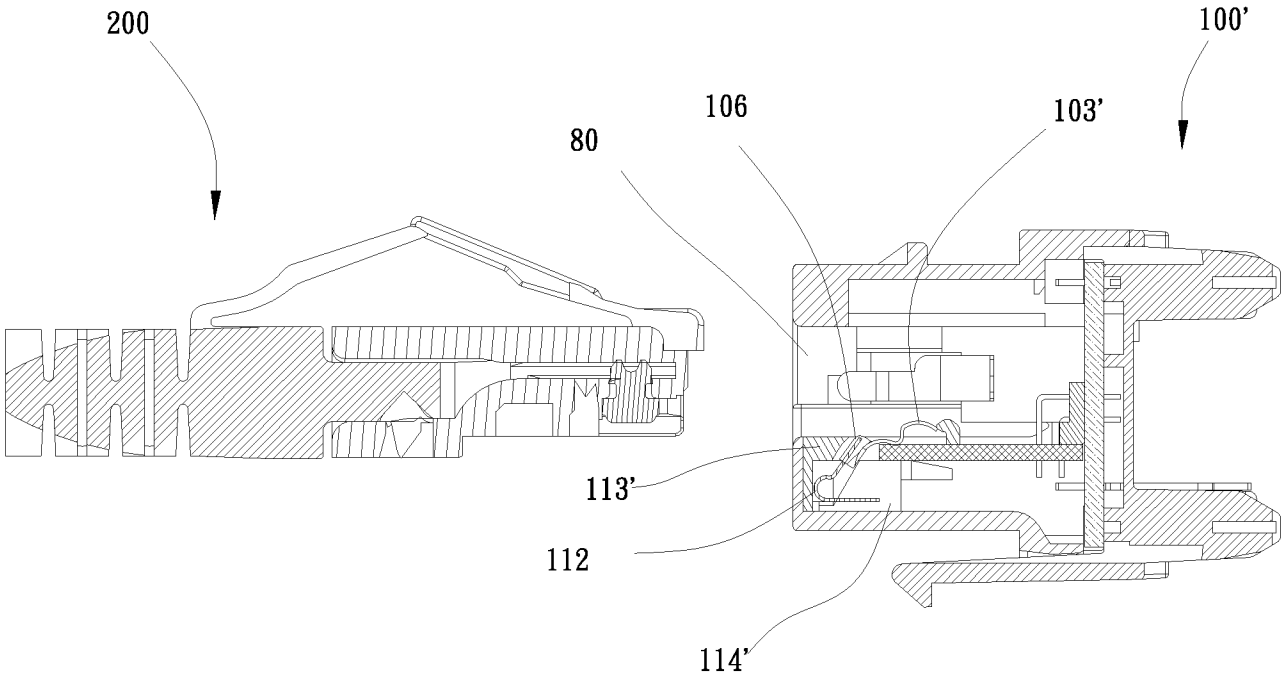
FIG. 9A is a side sectional view showing a communication plug aligned with the communication jack of FIG. 8, taken through a center thereof.
Figure 9B:
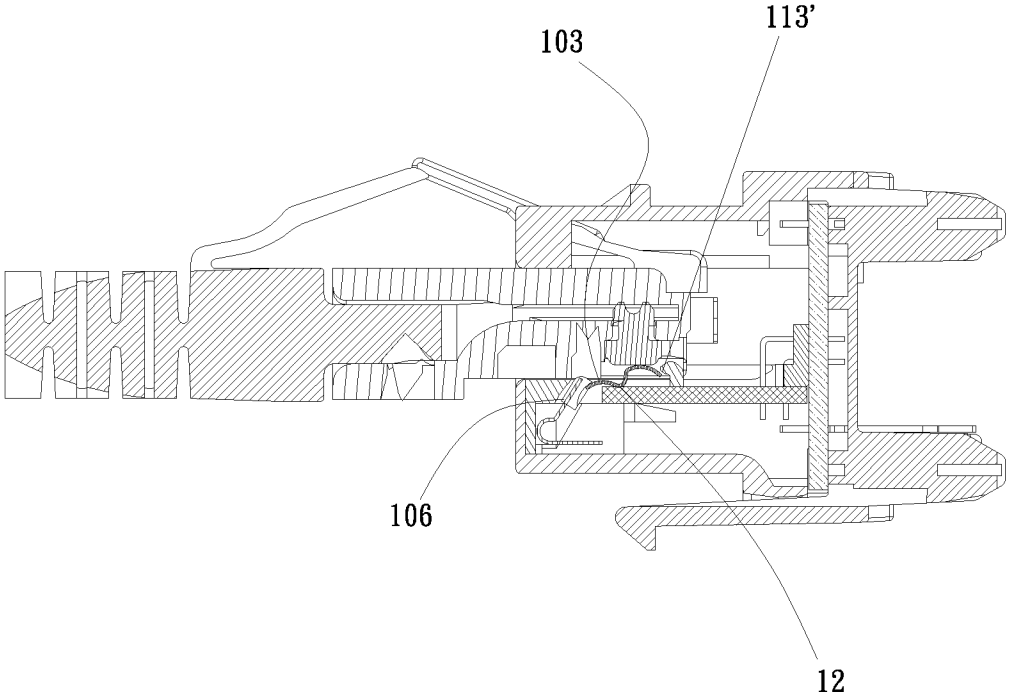
FIG. 9B is a side sectional view showing a communication plug mated with the communication jack of FIG. 8, taken through a center thereof.

The first fitting portion 114 comprises an insert base and the second fitting portion 113 comprises an insert cover with slots 24 and with corresponding aligned retaining portions 26 (FIG. 7). Each of the spring contacts 103 extends through one of the slots 24 to position the plug contact surface 14 and the extending end 16 on a side of the insert cover 113 with the plug receiving space 80. Each of the spring contacts 103 is configured and is guided by the support and guide region 30, to provide the extending spring arm portion 17 so as to have the pad contact portion 12 bear on the associated pad 111 and also such that the supported extending end 16 is biased into contact with the retaining surface 40 of the retaining portion 26.

FIG. 5A shows the plug 200 aligned with the communication jack 100. FIG. 5B shows the plug 200 inserted though the plug opening 120 of the communication jack 100. The spring contact arrangement 10 positions each of the spring contacts 103 such that each plug contact surface 14 is positioned in the plug contact receiving space 80 of the communication jack 100. Upon the plug 200 being inserted into the plug receiving space 80, the extending end 16 is moved relative to the retaining surface 40 against the spring bias of the spring contact 103. This ensures very good physical and electrical contact between the plug contact surface 14 and the respective plug contact 203 of the plug 200. This configuration provides a plug contact portion 19 with a plug contact surface 14 at one side of the pad contact portion 12 and a spring arm 17 with end portion in the support and guide region 30 for supported/guided end portion 18 at another side of the pad contact portion 12. This configuration of the of the spring contact 103 and the positioning and support with the spring contact arrangement 10 provides a stable and robust arrangement while providing excellent performance characteristics. This allows the spring contact 103 to move or flex at each side of the contact of the pad contact portion 12 against the pads 111. With the spring contact 103 divided into a contact portion 19 and a spring portion 17, the transmission length of the contact portion 19 may be very short but overall the spring contact 103 has good spring characteristics with a long flexible spring arm including both the contact portion 19 and the spring arm portion 17. A deflection of the contact portion 19 is transferred without constraint to the deflection of the spring arm portion 17.

Figure 3A:
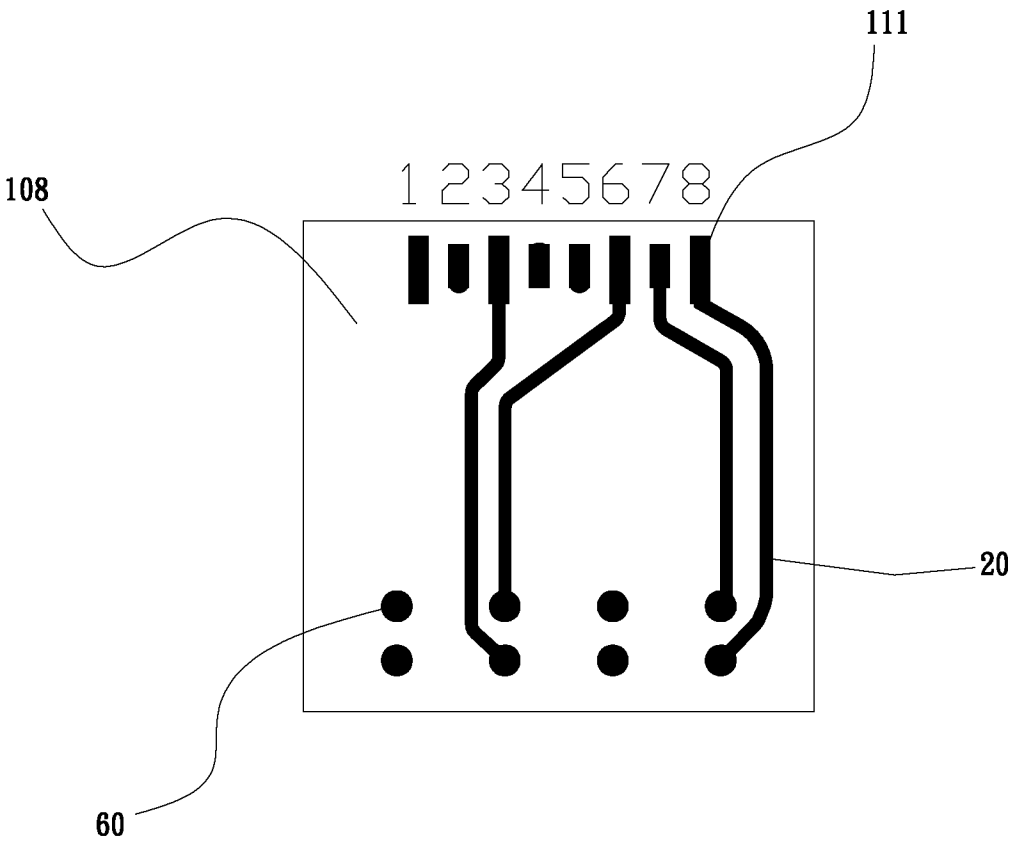
FIG. 3A is a top plan view of a circuit board with contact pads, of a circuit board arrangement of the embodiment of FIG. 1.
Figure 3B:
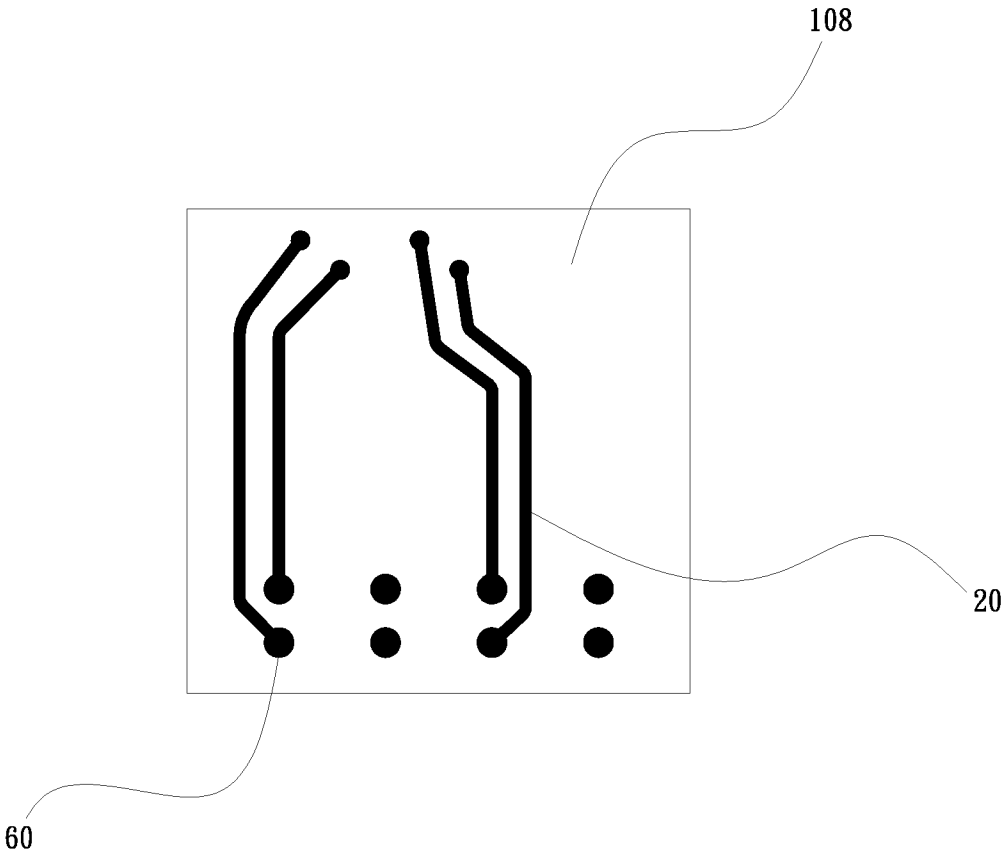
FIG. 3B is a bottom plan view of the circuit board of FIG. 3A.
Figure 4A:
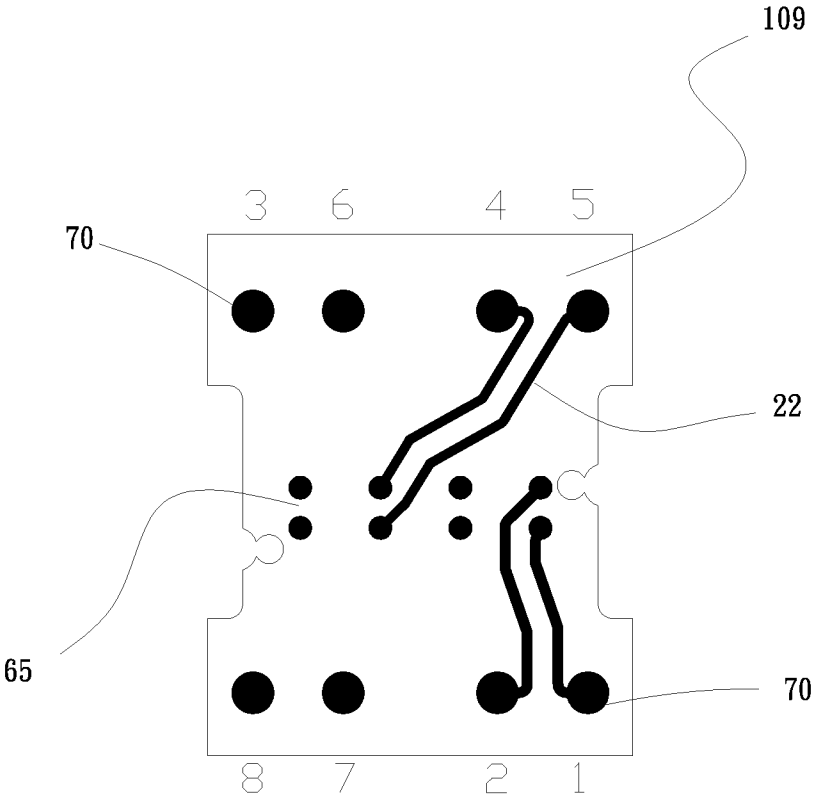
FIG. 4A is a front plan view of the IDC connection circuit board of the circuit board arrangement of the embodiment of FIG. 1.
Figure 4B:
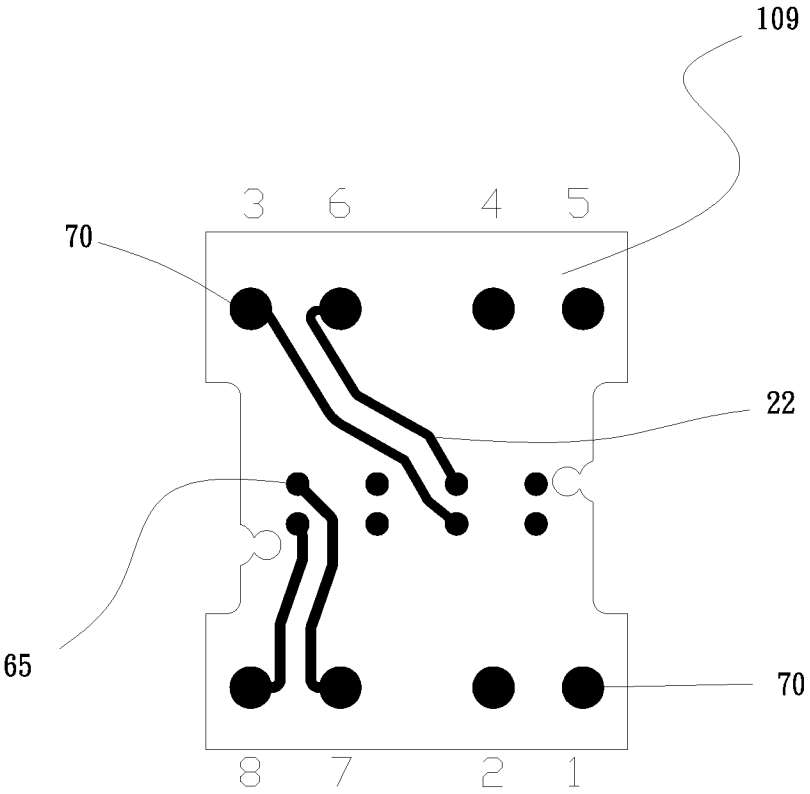
FIG. 4B is a rear plan view of the IDC connection circuit board of FIG. 4A.

The circuit arrangement provides transmission paths from the pads 111 on the circuit board 108 to connected IDCs (Insulation Displacement Contacts) 107 connected to circuit board 109. Plated through holes 70 are formed in the circuit board 109 and each receive one of the IDCs 107. Each of the contact pads 111 is part of a transmission path formed by traces 20 on the circuit board 108. The traces 20 extend from the respective contact pad 111 to one of the plated through holes 60 (FIGS. 3A and 3B). The plated through holes 60 each receive a pin of the pin head arrangement 110. Each pin is connected at another side to a plated through hole 65 of the circuit board 109. The circuit board 109 continues the transmission paths, with circuit traces 22 extending between plated through holes 65 and plated through holes 70 (FIGS. 4A and 4B). Each transmission path trace 22 connects one of the pins of the pin head 110 with an associated IDC 107.

The insert cover 113 is assembled with insert base 114 via engaging pins and holes provided on the insert cover 113 and the insert base 114. This connection of insert cover 113 and insert base 114 holds the spring contacts 103 at support and guide region 30 and forms the spring contact arrangement 10. The contact arrangement 10 is also connected with the circuit board 108 during assembly. The spring contacts 103 are disposed to extend through the slots 24. The assembly of the insert cover 113 with insert base 114 is such that a portion of the circuit board 108 is positioned therebetween. Each extending end 16 is disposed biased toward and supported at an associated retaining surface 40 of a retaining portion 26 of the insert cover 113. Each pad contact portion 12 of the spring contacts 103 is disposed in contact with an associated pad 111 of the circuit board 108. The circuit board 108 is then assembled with circuit board 109 via the pin head 110. The circuit board 109 is assembled with IDC contacts 107 and inserted into seat 102. The circuit board arrangement with circuit boards 108 and 109 is connected to seat housing part 102. The seat housing part 102 has slots corresponding the slots of the IDCs 107, to receive individual wires 502 of a cable 500. The seat 102, with connected circuit board arrangement with circuit board 109 with IDCs 107 and with circuit board 108 connected with the contact assembly 10, is snap connected to jack housing 101 to form an assembly as shown in FIGS. 5A and 5B.

The housing 101 has a plug opening 120 that is sized to receive the RJ plug 200. The plug opening may have a grounding spring 105 as shown in FIG. 1. With the plug 200 inserted through the plug opening 120, the plug contacts 203 physically and electrically contact associated plug contact surfaces 14 of the spring contacts 103. Because of the very short length of the contact portion 19, the associated transmission path between the plug contact 203 of the plug 200 and the pads 111 of the circuit board 108 is short, providing excellent performance including a lower phase shift between the plug crosstalk and with compensation crosstalk at a high frequency region. Further, the flexibility at the spring arm portion 17 to the pad contact portion 12 and the flexibility of the contact portion 19 from the pad contact portion 12 to the moveably supported extending end 16 allows the spring contact 103 to have excellent spring characteristics. The configuration avoids the problem of a short contact portion with poor spring characteristics associated with a short cantilever beam structure.

A second embodiment of a communication jack 100' is shown in FIGS. 8-11. The communication jack 100' includes features similar to the first embodiment of the communication jack 100 and the same reference numerals are used with regard to features which are essentially the same. However, the communication jack 100' includes a different spring contact arrangement 10', which is explained below.

Figure 10A:
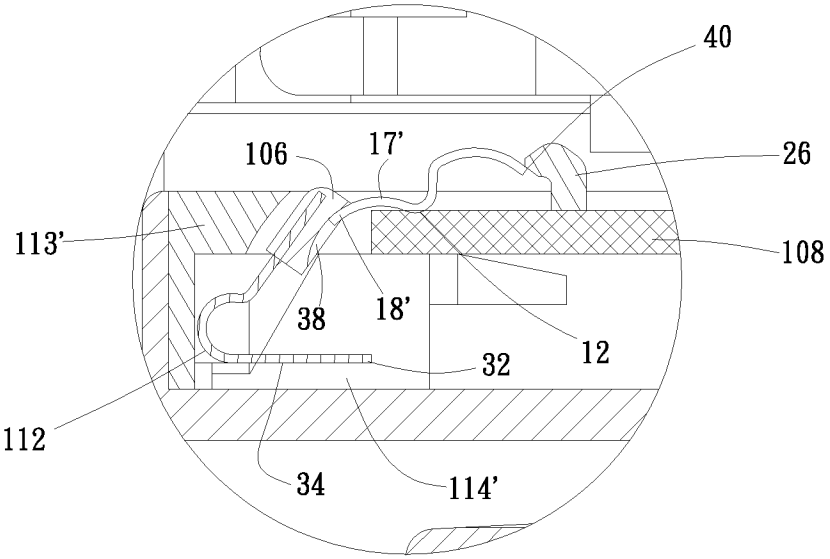
FIG. 10A is an enlarged side sectional view showing a portion of the plug receiving space, in an unmated state, of the communication jack of FIG. 8.
Figure 10B:
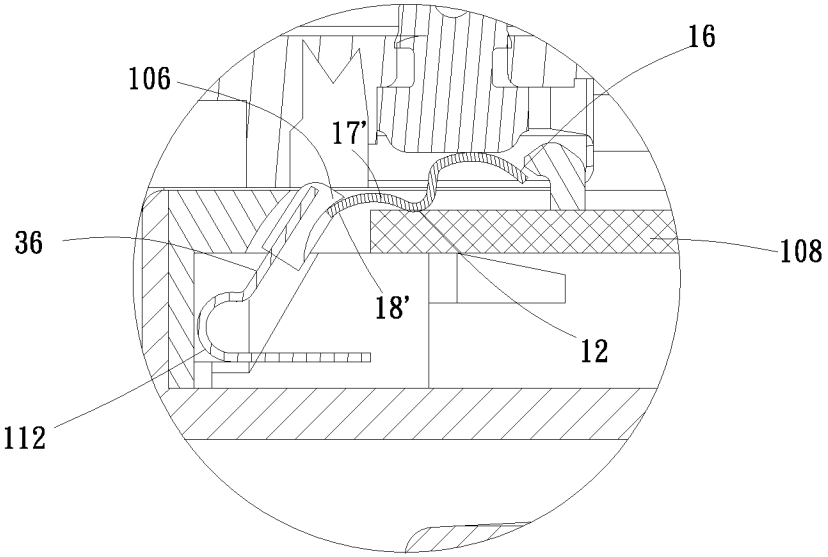
FIG. 10B is an enlarged side sectional view showing a portion of the plug receiving space, in a mated state, of the communication jack of FIG. 8.

The spring contact arrangement 10' is formed of a first fitting portion or insert base 114' and a second fitting portion or insert cover 113'. The insert base 114' has a plurality of biasing springs 112 that have ends 32 that are inserted into receiving passages 34 of the insert base 114'. This can be seen in the cross-sectional view of the spring contact arrangement 10' in FIGS. 10A and 10B and in the cross-sectional view of the spring contact arrangement 10' in FIG. 11. Each of the biasing springs 112 extends from the supported/guided, inserted end 32. The end 32 is received in the receiving passage 34 of the insert base 114' and has a biasing spring arm 36 (FIG. 10B). The spring arm 36 includes a curved portion to change the direction of the biasing spring arm 36, such that the biasing spring arm extends upwardly to the slots 24' of the insert 113'. At an upper end of each biasing spring arm 36, a holder 106 is insert molded on the spring 112. Each holder 106 is formed of an insulating material, such as plastic. Each holder 106 has a receiving slot 38 that receives a supported/guided end portion 18' of the associated spring contact 103'. This provides support and a sliding guide for the supported/guided end portion 18' at the support/guide or holder 106. The receiving slot 38 has parallel side walls to accommodate a width of the supported/guided end portion 18'. The receiving slot 38 also has a curved support surface that allows some interaction with the curved shape of the supported/ guided end portion 18', allowing a smooth movement of the supported/guided end portion 18' relative to the holder 106, in a direction further into or out of the receiving slot 38.

Figure 11:
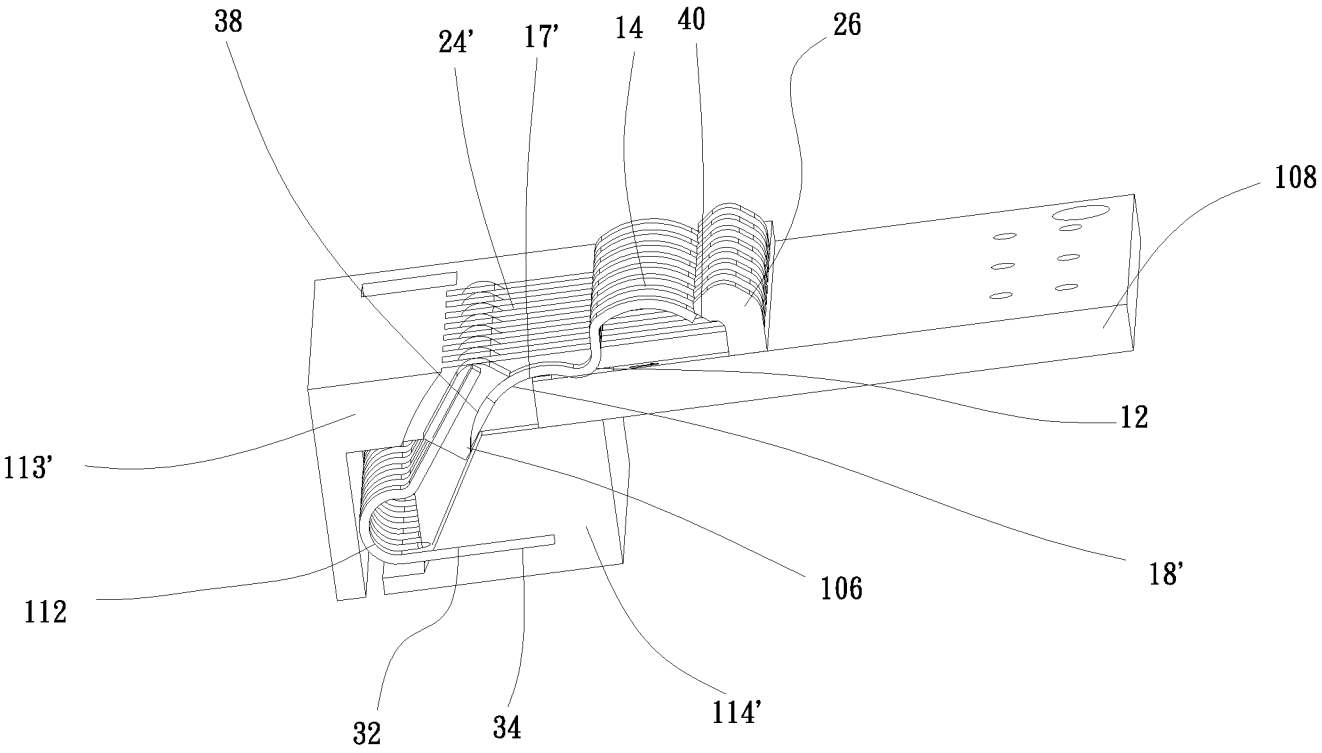
FIG. 11 is a side perspective sectional view showing a subassembly with a first fitting portion, a second fitting portion, spring contacts, biasing springs, insulator holders and circuit board with pads of the communication jack of FIG. 8.
Figure 12:
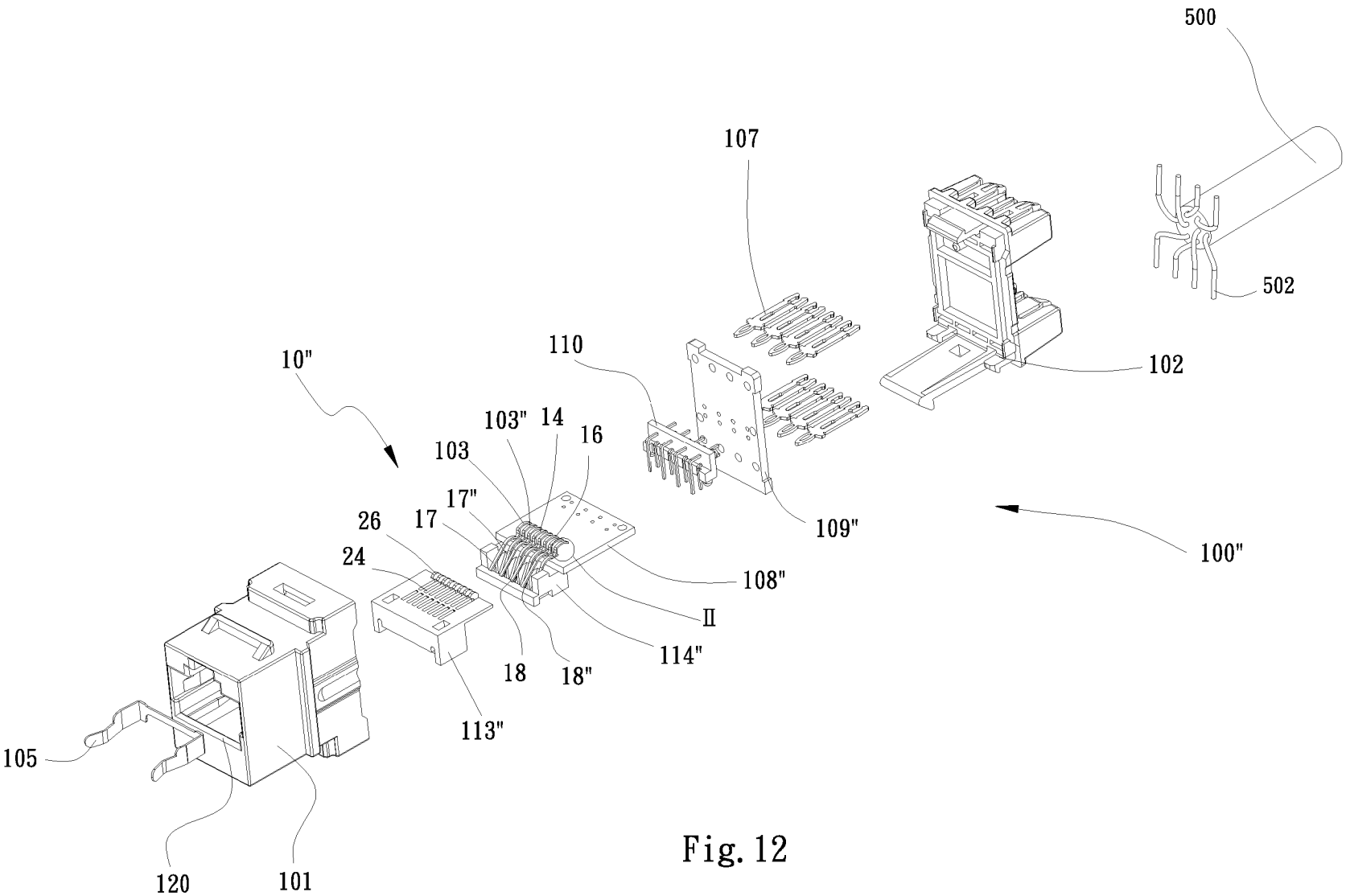
FIG. 12 is an exploded view of a communication jack according to another embodiment of the invention.
Figure 13:
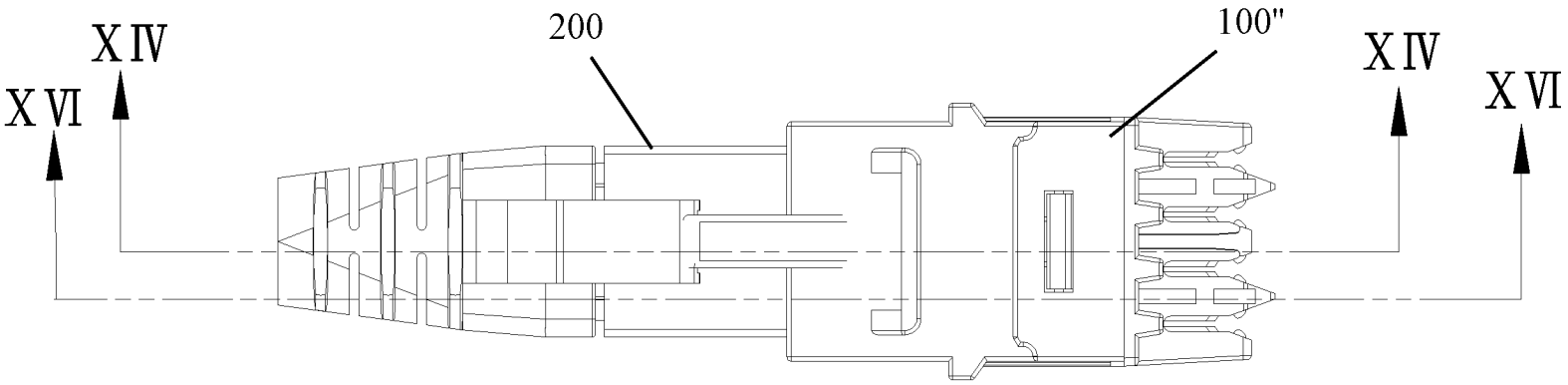
FIG. 13 is a top view showing a communication plug aligned and mated with the communication jack of FIG. 12.
Figure 14A:
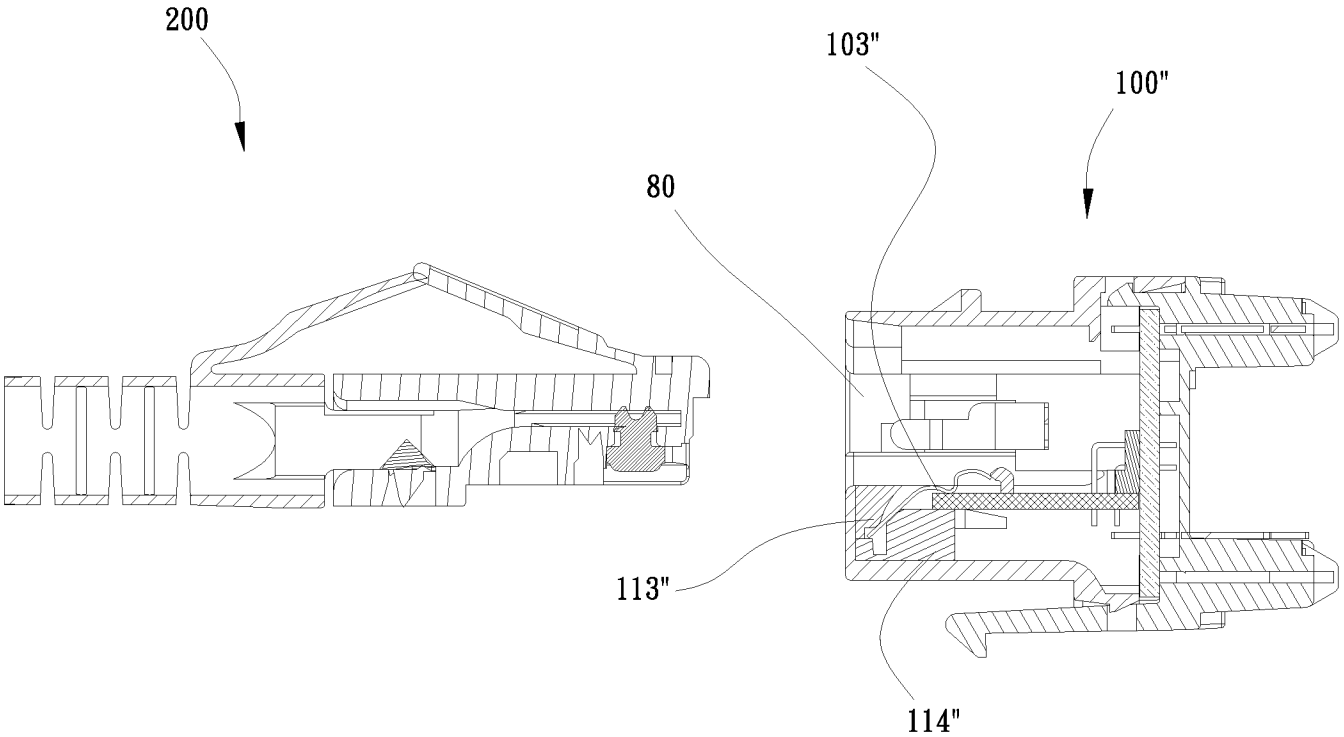
FIG. 14A is a side sectional view showing a communication plug aligned with the communication jack of FIG. 12, corresponding to line XIV-XIV of FIG. 13.
Figure 14B:
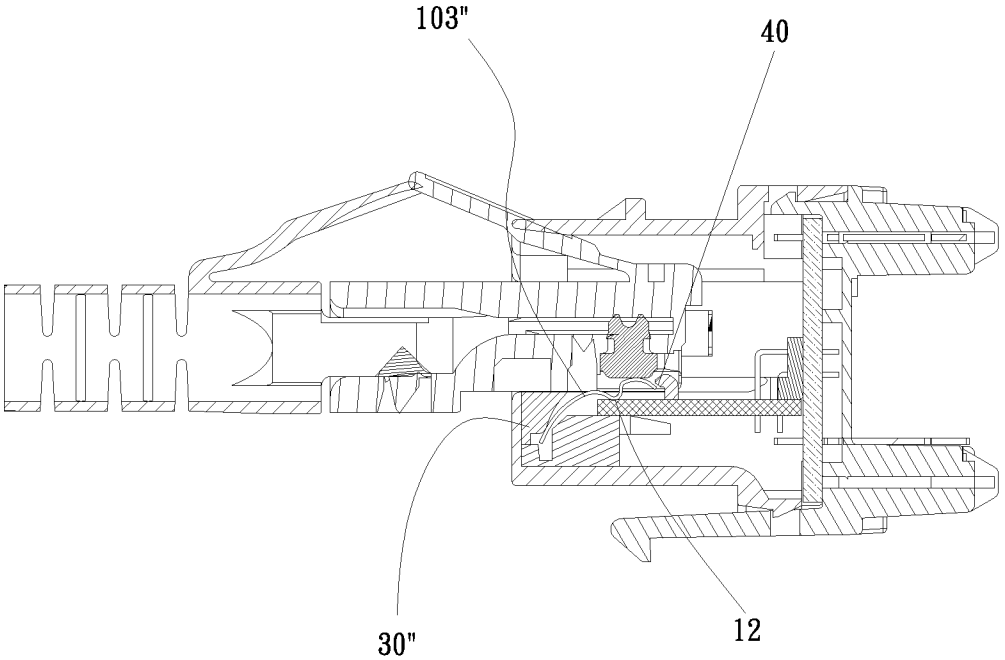
FIG. 14B is a side sectional view showing a communication plug mated with the communication jack of FIG. 12, taken along line XIV-XIV of FIG. 13.

The insert cover 113' is assembled with insert base 114' such that a portion of the circuit board 108' is positioned therebetween. The configuration of the biasing spring 112 in cooperation with the insert base 114', particularly shown in FIG. 11, is such that the holder 106 is biased forward. This presses and holds the supported/guided portion 18'. However, the holders 106 are able to move within the slot 24', based on a dimensioning of the slot 24'. This provides a spring arm portion 17' of the spring contact 103' that is very short but which may still flex and move, at one side of the pad contact portion 12. A remainder of the spring contact 103' is similar to the spring contact 103 discussed above and includes a very short contact portion 19, leading from the pad contact portion 12 to the plug contact surface 14. The contact spring 103' also has an extending end 16 which is movable and is biased to engage retaining surface 40 of retaining portion 26. The configuration provided by the spring contact arrangement 10' allows the spring contact 103' to move or flex at each side of the pad contact portion 12, that contacts the pads 111. The use of the biasing spring 112 with the nonconductive holder 106 provides good flexural aspects for the spring contact 103' at the spring arm 17' side of the spring contact 103' (the side that does not provide the transmission path between the plug contact 203 and the pad 111). The good flexural aspects are provided while at the same time the length of the spring arm portion 17' is very short. The short length of spring arm 17' reduces coupling between adjacent spring arm 17' making crosstalk easier to compensate. This provides enhanced performance attributes for the communication jack 100' as compared to the communication jack 100.

A third embodiment of a communication jack 100" is shown in FIGS. 12-18. The communication jack 100" includes features similar to the first embodiment of the communication jack 100 and the same reference numerals are used with regard to features which are essentially the same. However, the communication jack 100" includes a different spring contact arrangement 10", which is explained below.

Figure 15A:
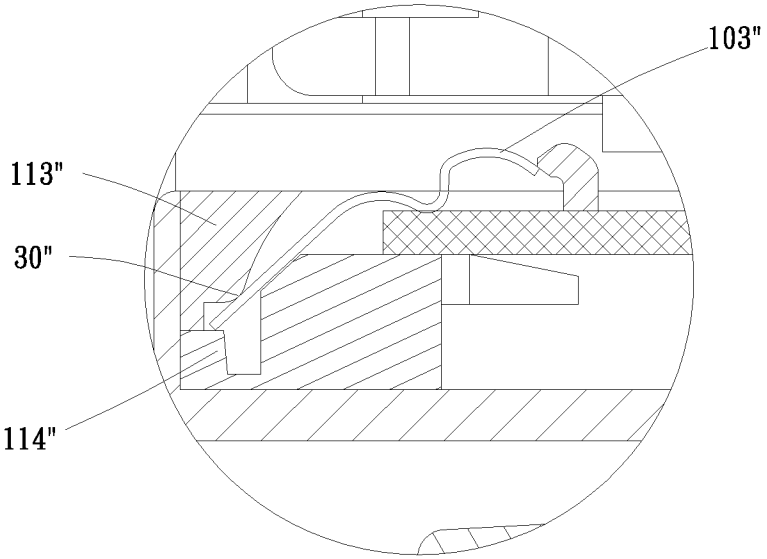
FIG. 15A is an enlarged side sectional view corresponding to a portion of FIG. 14A, showing a portion of the plug receiving space, in an unmated state, of the communication jack of FIG. 12.
Figure 15B:
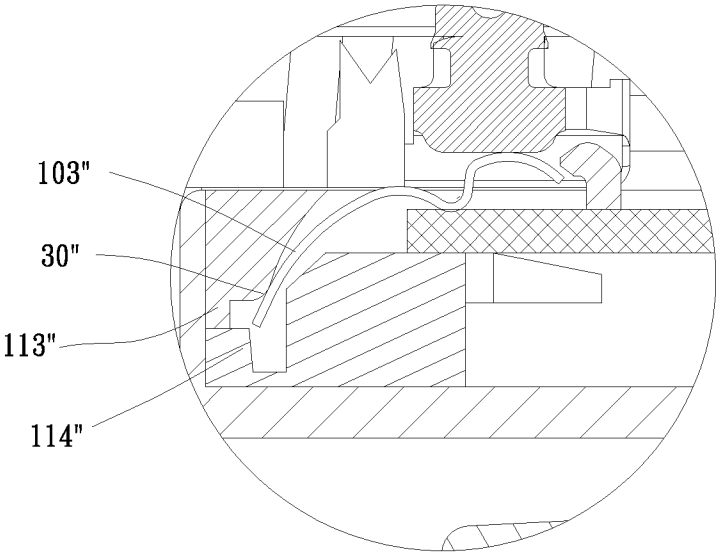
FIG. 15B is an enlarged side sectional view corresponding to a portion of FIG. 14B, showing a portion of the plug receiving space, in a mated state, of the communication jack of FIG. 12.
Figure 16A:
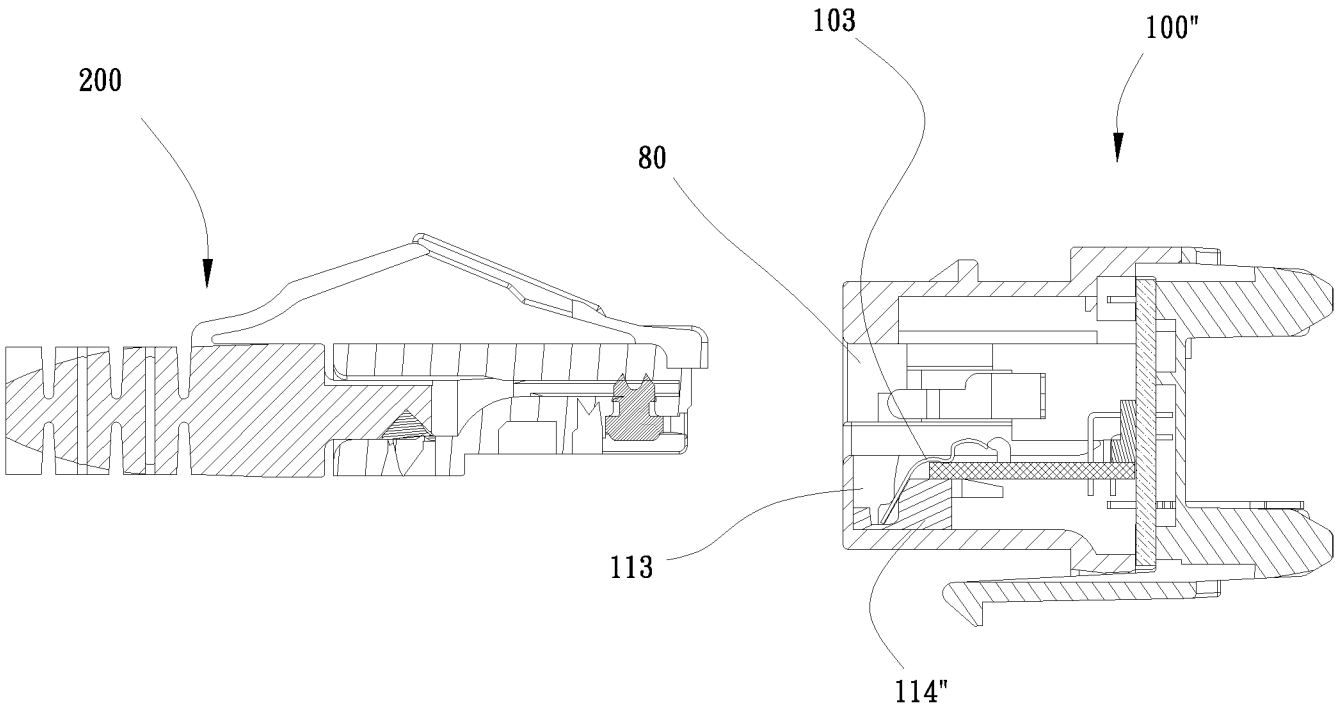
FIG. 16A is a side sectional view showing a communication plug aligned with the communication jack of FIG. 12, corresponding to line XVI-XVI of FIG. 13.
Figure 16B:
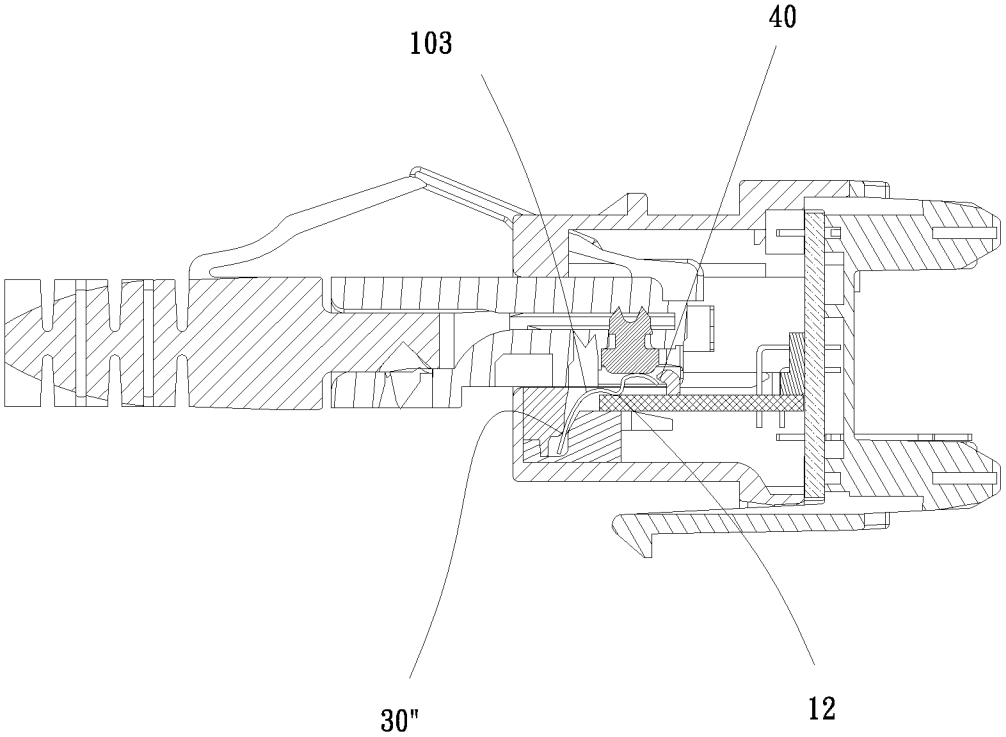
FIG. 16B is a side sectional view showing a communication plug mated with the communication jack of FIG. 12, taken along line XVI-XVI of FIG. 13.
Figure 17A:
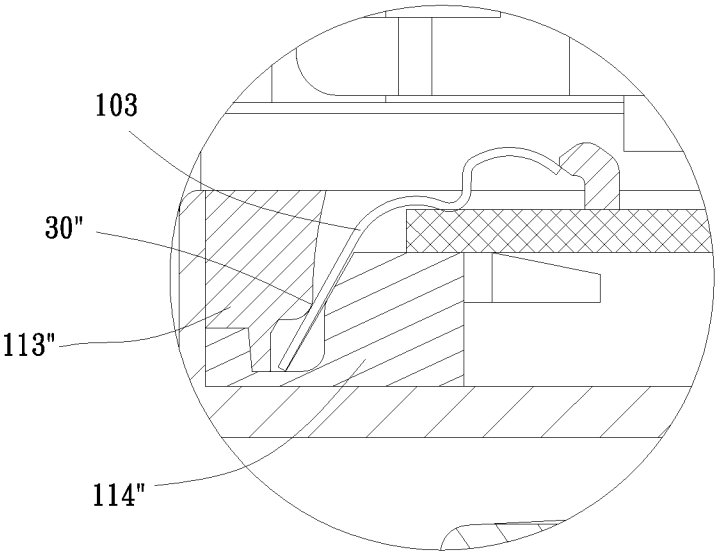
FIG. 17A is an enlarged side sectional view corresponding to a portion of FIG. 16A, showing a portion of the plug receiving space, in an unmated state, of the communication jack of FIG. 12.
Figure 17B:
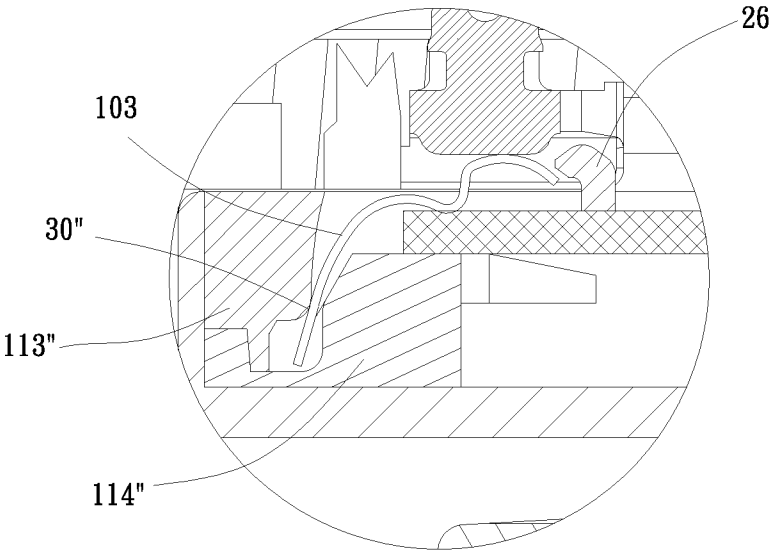
FIG. 17B is an enlarged side sectional view corresponding to a portion of FIG. 16B, showing a portion of the plug receiving space, in a mated state, of the communication jack of FIG. 12.
Figure 18:
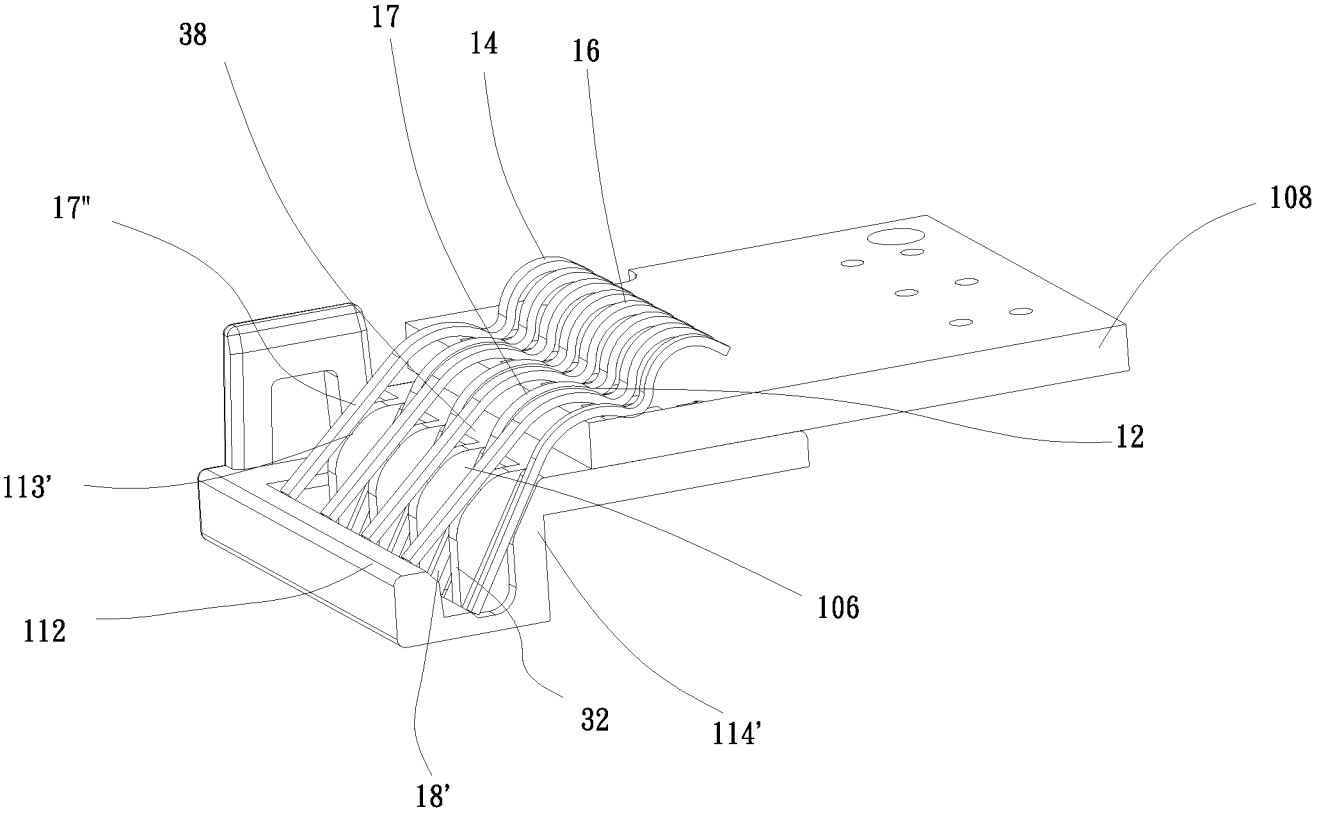
FIG. 18 is a side perspective sectional view showing a subassembly with a first fitting portion, spring contacts and circuit board with pads of the communication jack of FIG. 12.
Figure 19:
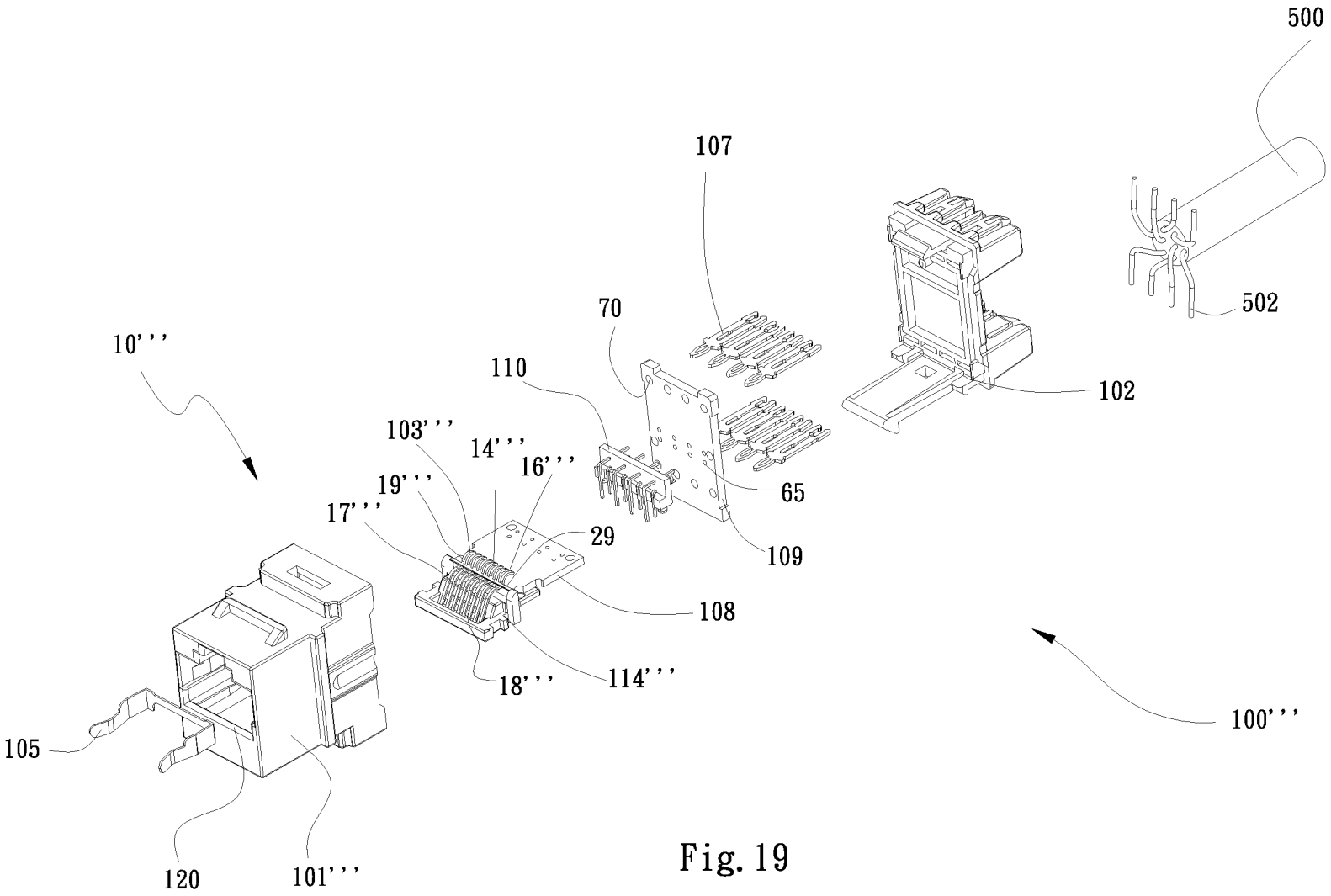
FIG. 19 is an exploded view of a communication jack according to another embodiment of the invention.
Figure 20A:
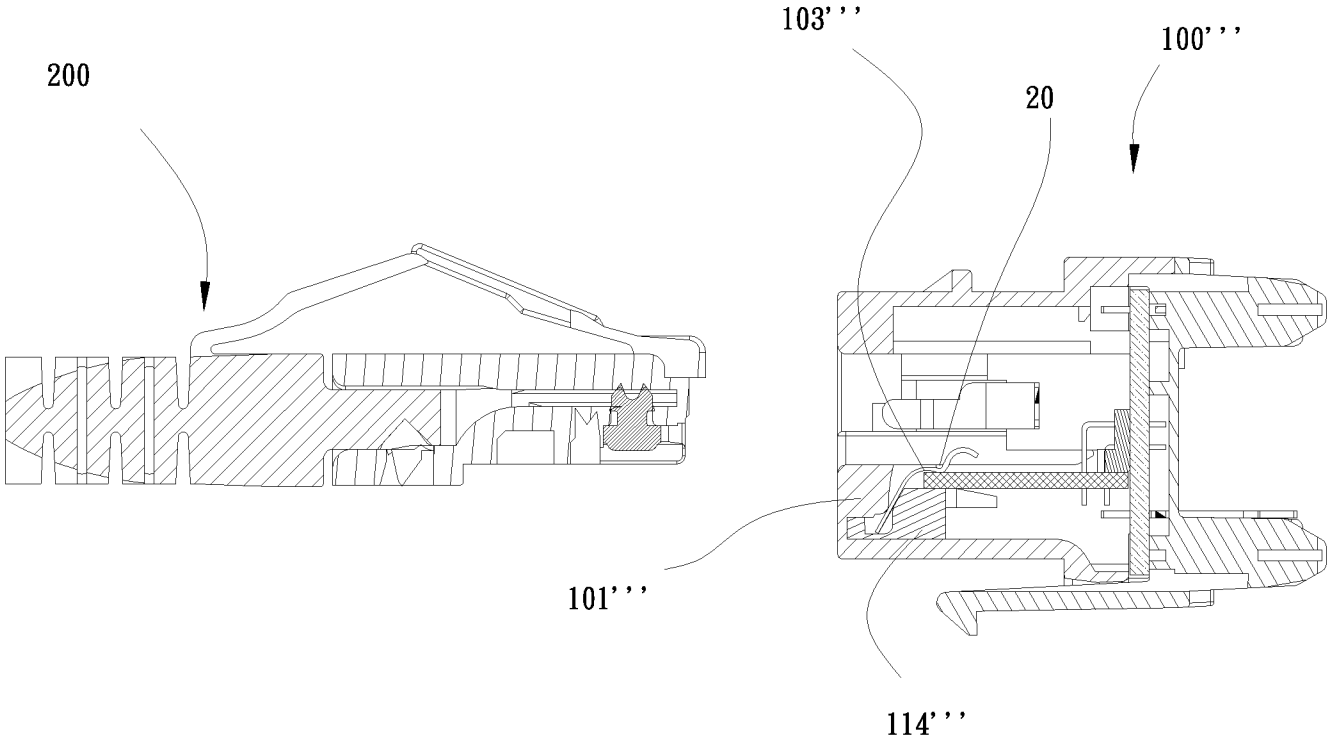
FIG. 20A is a side sectional view showing a communication plug aligned with the communication jack of FIG. 19, taken through a center thereof.
Figure 20B:
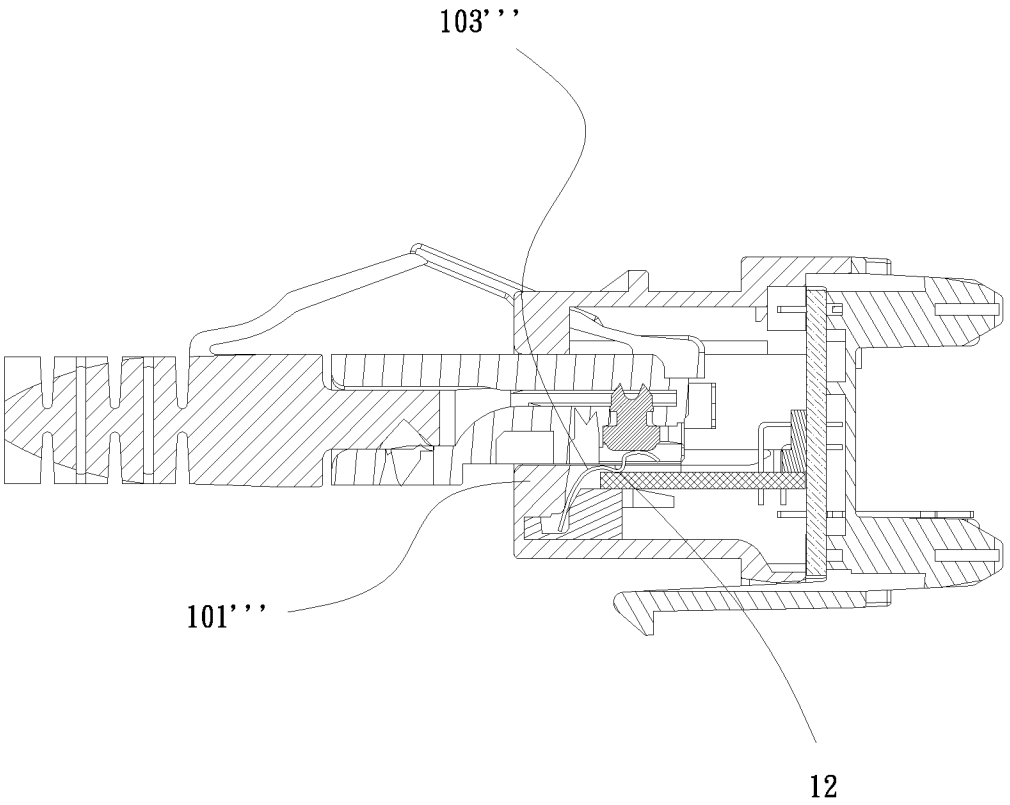
FIG. 20B is a side sectional view showing a communication plug mated with the communication jack of FIG. 19, taken through a center thereof.

The spring contact arrangement 10" is formed of a first fitting portion or insert base 114" and a second fitting portion or insert cover 113". The spring contact arrangement 10" supports spring contacts 103 and spring contacts 103". The spring contacts 103 are essentially the same as the spring contacts mentioned above with respect to the spring contact arrangement 10. The spring contacts 103" are similar to the spring contacts 103 but each has a supported/guided portion 18" that has a different shape as compared to the supported/guided portion 18 of the spring contacts 103. The shape and course of the supported/guided portion 18" diverges from the shape and course of the supported/guided end portion 18. This provides a configuration such that each supported/guided end portion 18 and the adjacent supported/guided portion 18" are at different angles from each other and at different angles relative to the communication jack 100". The first fitting portion 114" and the second fitting 113" hold (position, support, guide) the spring contacts 103 and 103" and position the spring contacts 103 and 103", based on a spring contact guiding region 30", that accommodates the shape of the spring contacts 103 (FIGS. 17A and 17B) and accommodates the shape of the spring contacts 103" (FIGS. 15A and 15B). This provides support and a sliding guide for the supported/guided end portions 18, 18" at the support and guide region 30". The support/guide regions 30" provide extending spring arm portions 17" and 17 that are not parallel. The spring arm portion 17" and 17 allow the associated pad contact portion 12 to bear on the associated pad 111. The supported extending end 16 is biased into contact with the retaining surface 40 of the retaining portion 26. The contact arrangement 10" positions each of the spring contacts 103 and 103" such that each plug contact surface 14 is positioned in the plug contact receiving space 80 of the communication jack 100". The configuration again allows the spring contact 103 and 103" to move or flex at each side of the contact of the pad contact portion 12 against the pads 111. Further, the non-parallel configuration of the spring contact 103 and 103" lowers coupling between adjacent spring contact 103 and 103" and provides enhanced performance attributes for the communication jack 100" as compared to the communication jack 100.

A forth embodiment of a communication jack 100'" is shown in FIGS. 19-21B. The communication jack 100'" includes features similar to the first embodiment of the communication jack 100 and the same reference numerals are used with regard to features which are essentially the same. However, the communication jack 100'" includes a different spring contact arrangement 10'", which is explained below.

Figure 21A:
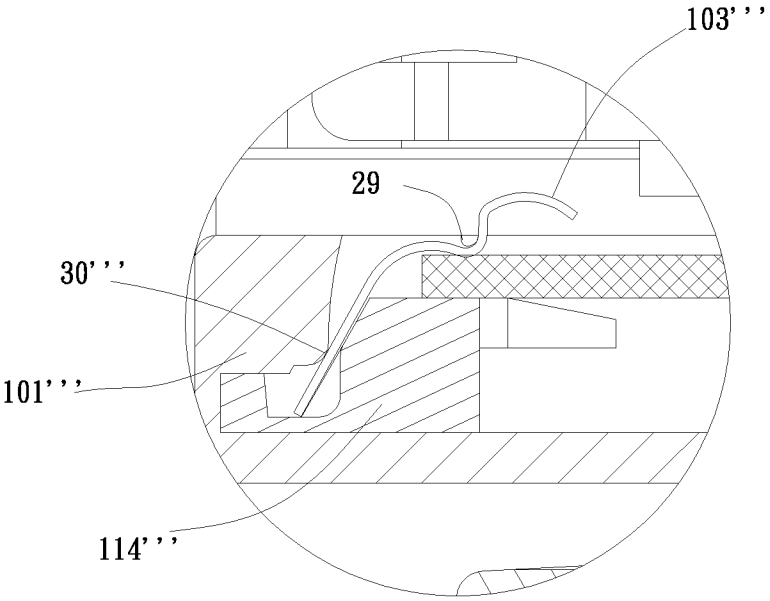
FIG. 21A is an enlarged side sectional view corresponding to a portion of FIG. 20 showing a portion of the plug receiving space, in an unmated state, of the communication jack of FIG. 19.
Figure 21B:
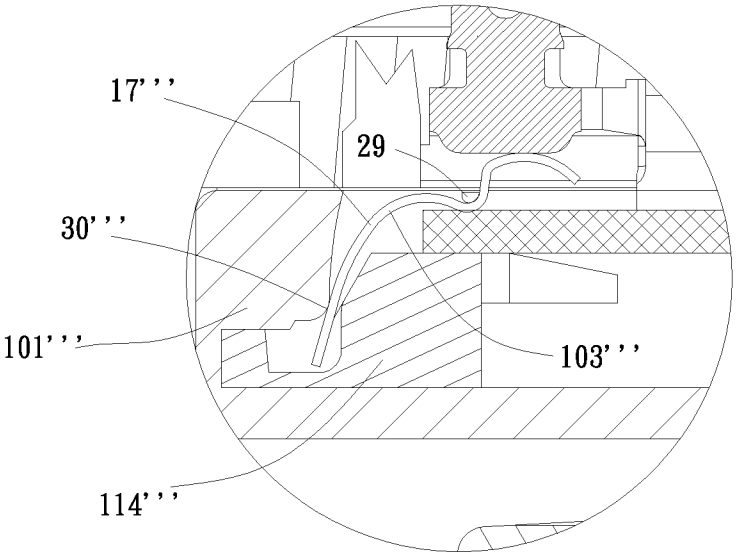
FIG. 21B is an enlarged side sectional view corresponding to a portion of FIG. 20B showing a portion of the plug receiving space, in a mated state, of the communication jack of FIG. 19.
Figure 22:
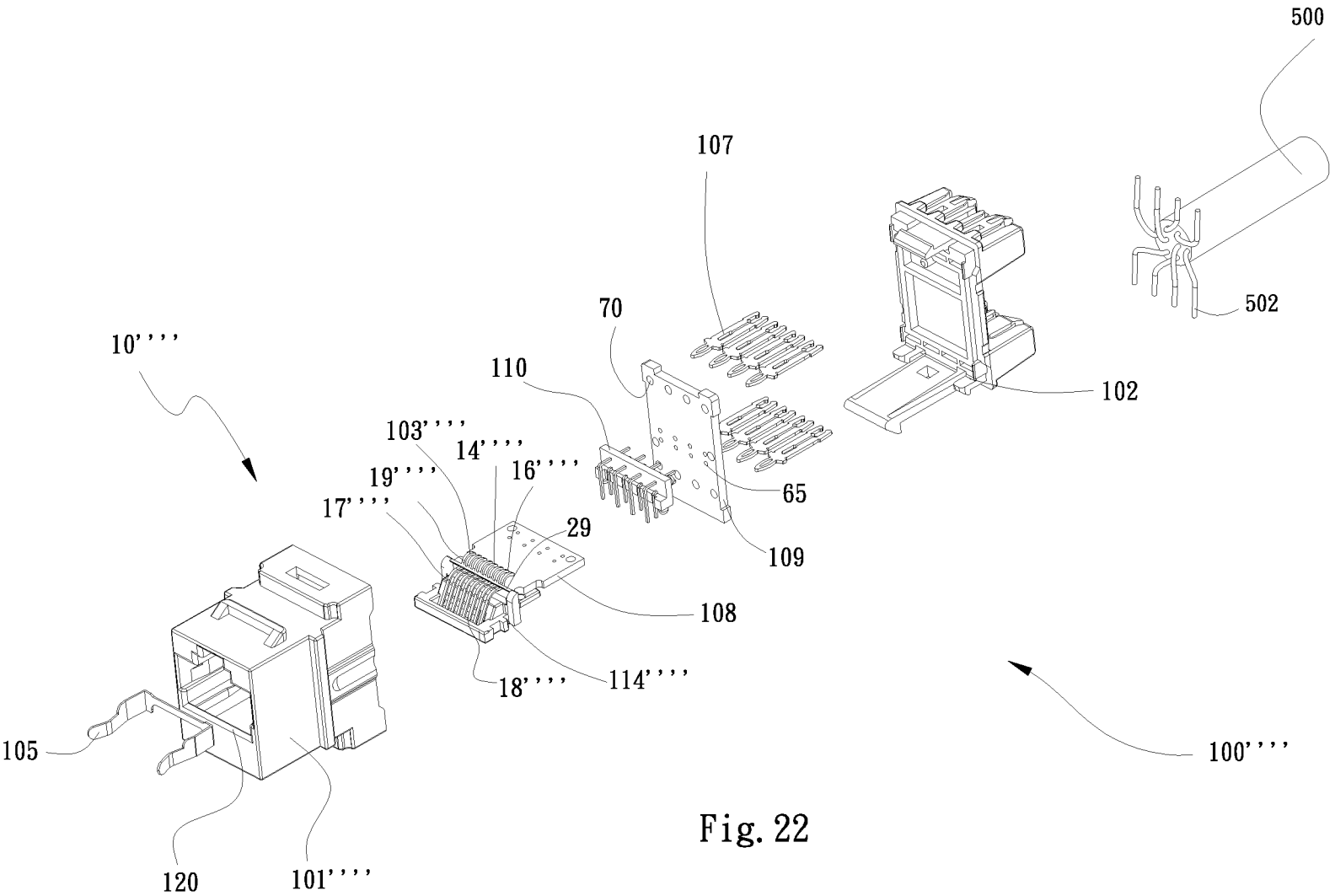
FIG. 22 is an exploded view of a communication jack according to another embodiment of the invention.
Figure 23A:
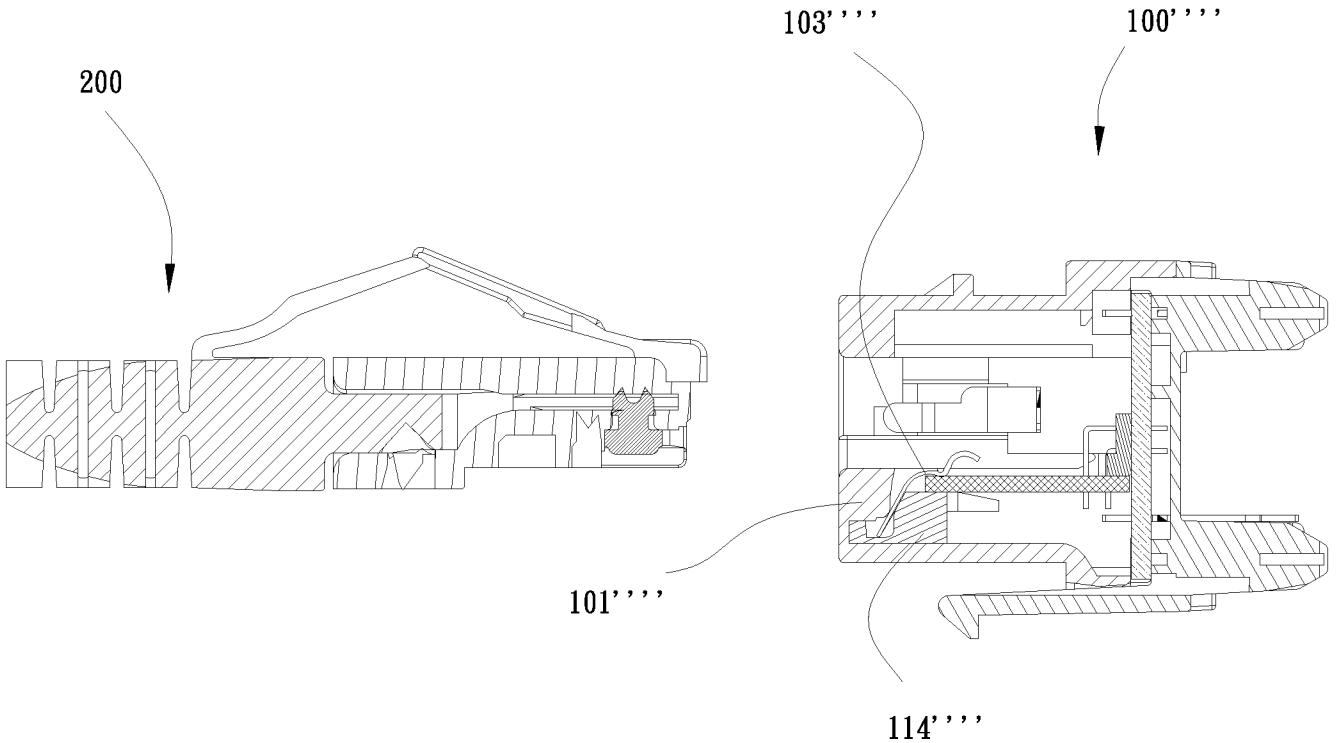
FIG. 23A is a side sectional view showing a communication plug aligned with the communication jack of FIG. 22, taken through a center thereof.
Figure 23B:
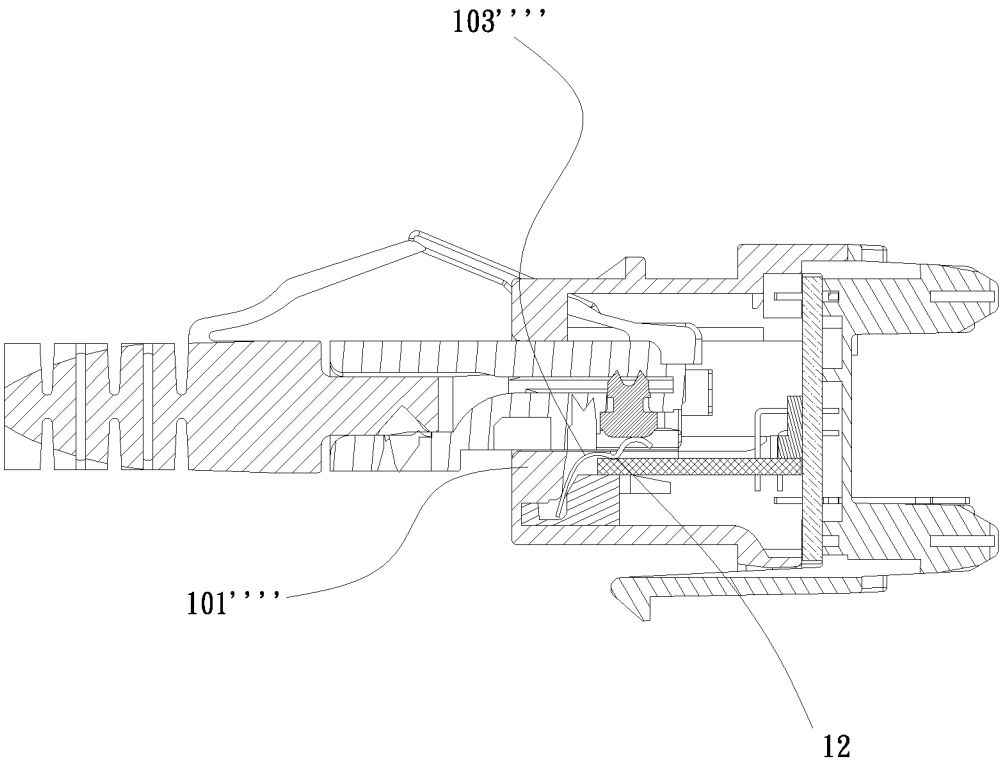
FIG. 23B is a side sectional view showing a communication plug mated with the communication jack of FIG. 22, taken through a center thereof.

The spring contact arrangement 10'" is formed of a first fitting portion or insert base 114'" and a second fitting portion that is unitary body portion of the housing part 101'". The spring contact arrangement 10'" supports spring contacts 103'". The spring contacts 103'" are essentially the same as the spring contacts mentioned above with respect to the spring contact arrangement 10. However, instead of interacting with a retaining surface 40 of a retaining portion 26, the spring contacts 103'" are retained by retaining bar 29. The retaining bar 29 is a portion of the first fitting portion or insert base 114'". The first fitting portion 114'" and the second fitting portion of the housing part 101'" hold the spring contacts 103'" and position the spring contacts 103'", based on a spring contact guiding region 30'" that accommodates the spring contacts 103'" (FIGS. 21A and 21B). This provides support and a sliding guide for the end portion 18'" at the support and guide region 30'". The configuration again allows the spring contact 103'" to move or flex at each side of the contact of the pad contact portion 12 against the pads 111.

A fifth embodiment of a communication jack 100"" is shown in FIGS. 22-25. The communication jack 100"" includes features similar to the first embodiment of the communication jack 100 and the same reference numerals are used with regard to features which are essentially the same. However, the communication jack 100"" includes a different spring contact arrangement 10"".

Figure 24A:
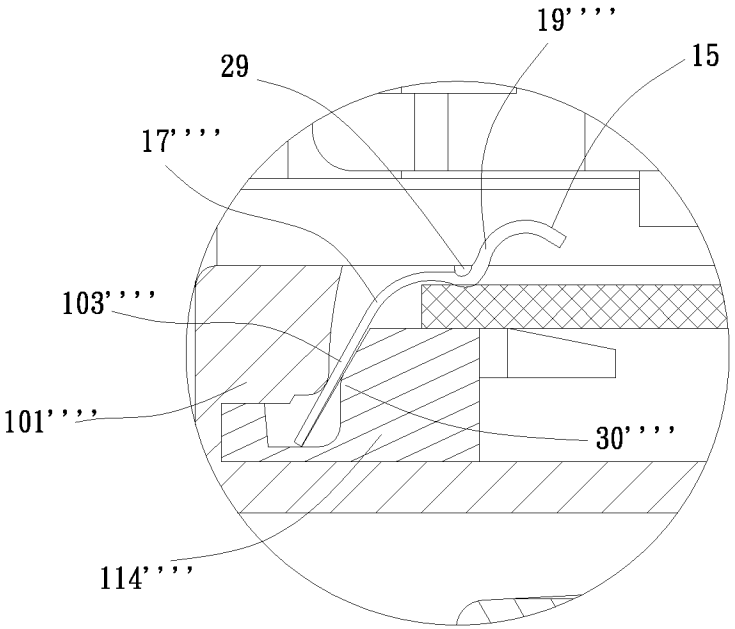
FIG. 24A is an enlarged side sectional view, corresponding to a portion of FIG. 23A, showing a portion of the plug receiving space, in an unmated state, of the communication jack of FIG. 22.
Figure 24B:
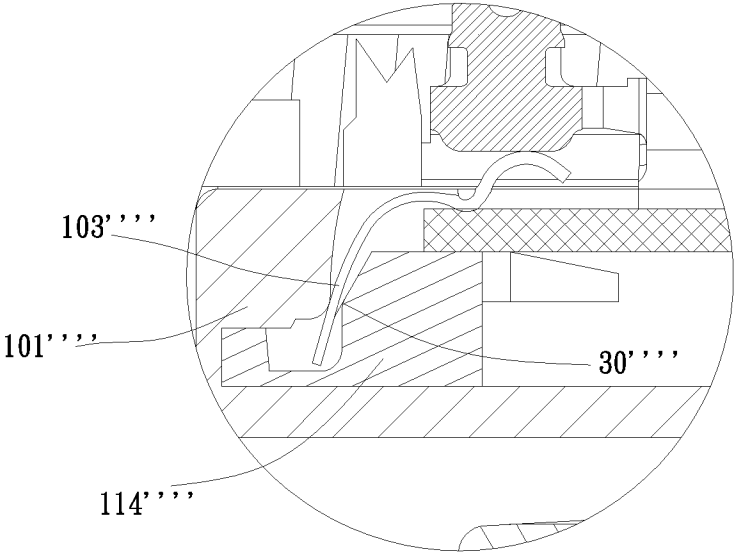
FIG. 24B is an enlarged side sectional view, corresponding to a portion of FIG. 23B showing a portion of the plug receiving space, in a mated state, of the communication jack of FIG. 22.
Figure 25:
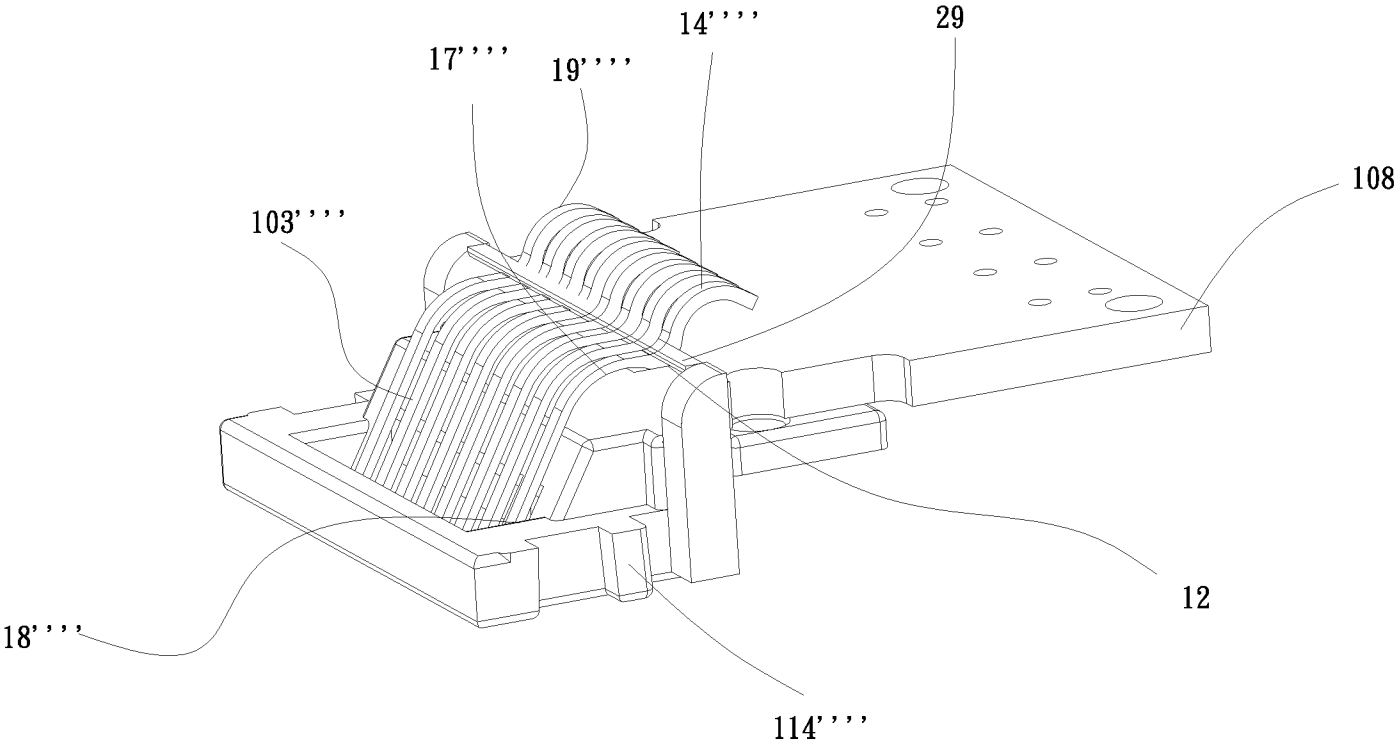
FIG. 25 is a side perspective sectional view showing a subassembly with a first fitting portion, a second fitting portion, spring contacts and circuit board with pads of the communication jack of FIG. 22.
Figure 26:
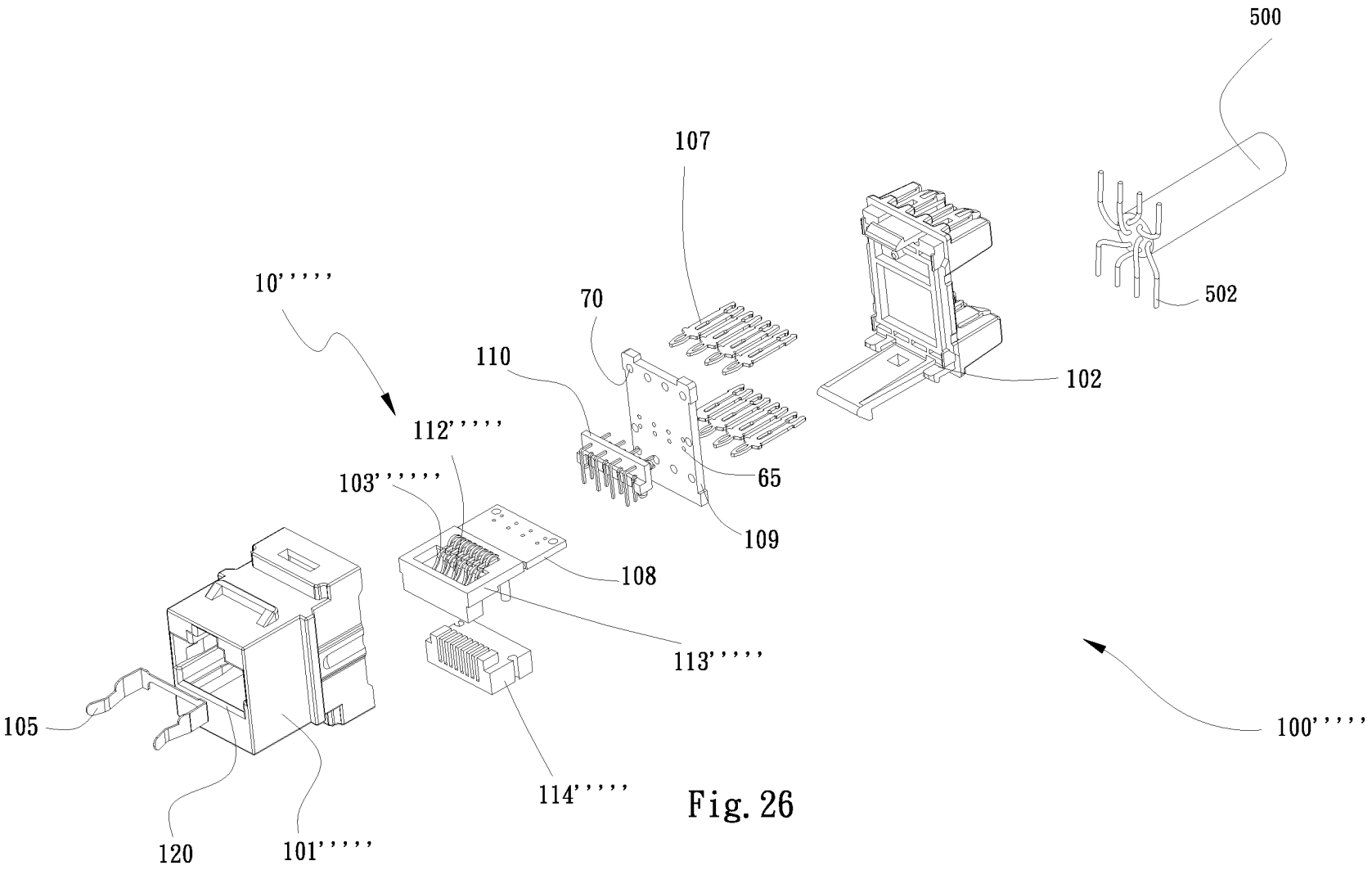
FIG. 26 is an exploded view of a communication jack according to another embodiment of the invention.
Figure 27A:
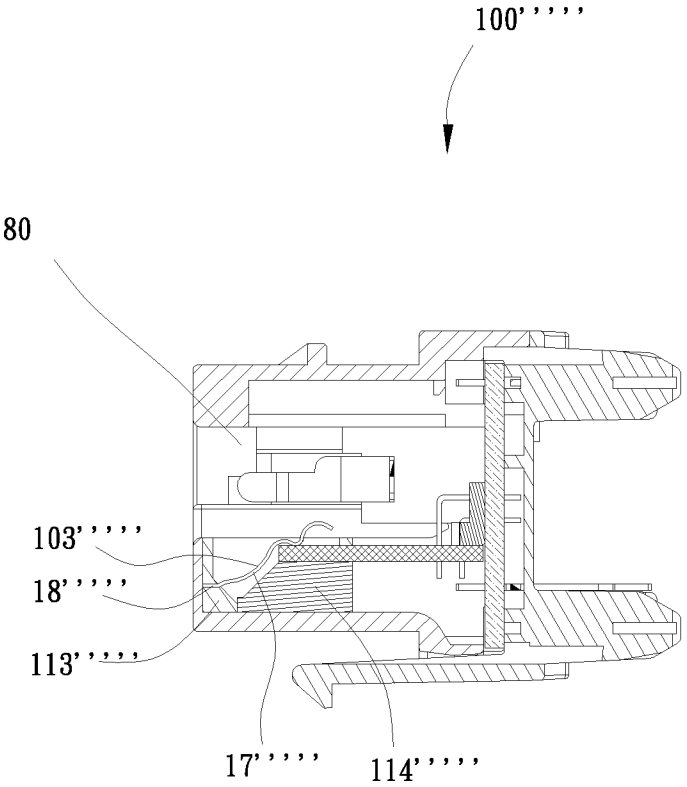
FIG. 27A is a side sectional view showing a communication plug aligned with the communication jack of FIG. 26, taken along a section line so as to view a spring contact of a first set of spring contacts.
Figure 27A:
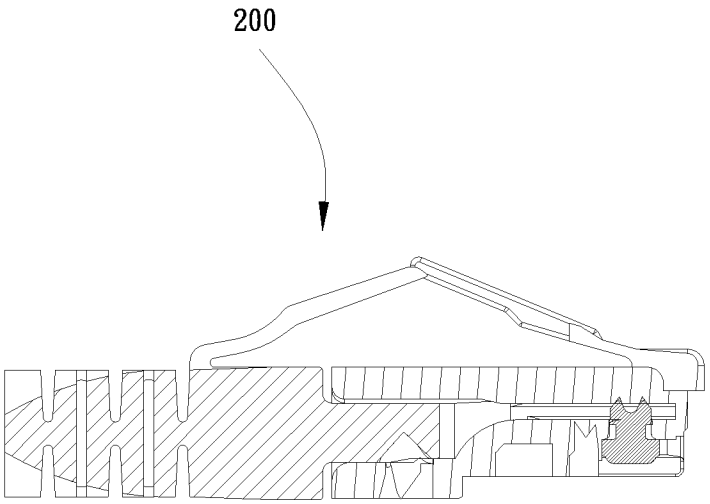
Figure 27B:
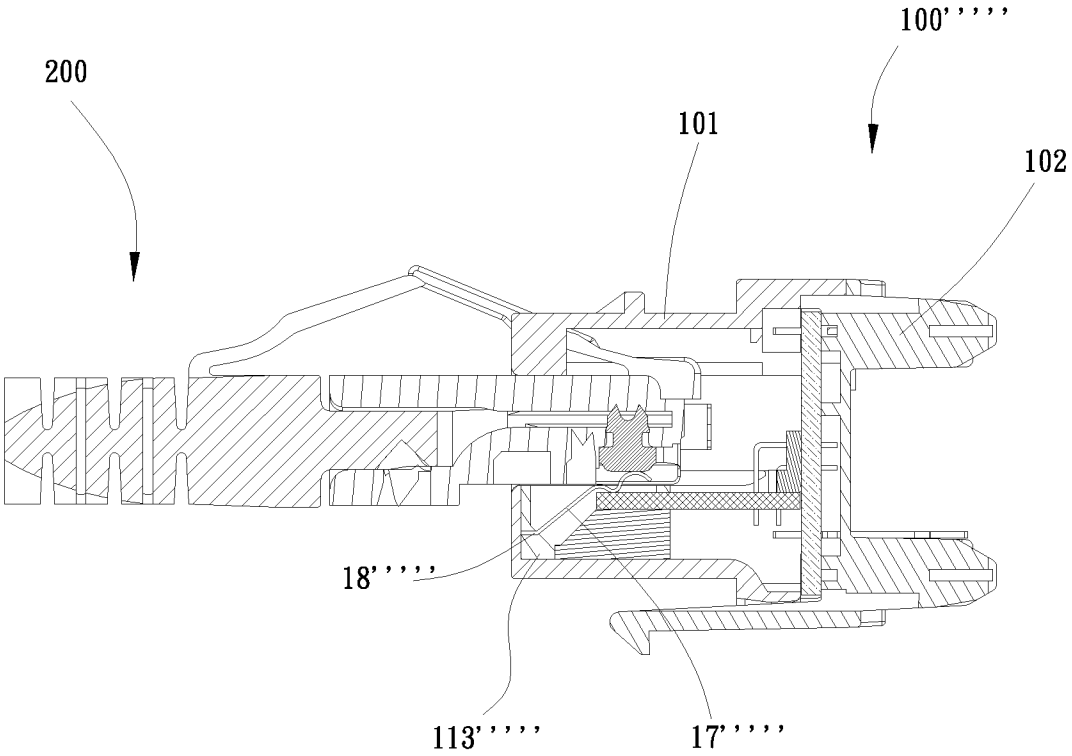
FIG. 27B is a side sectional view showing a communication plug mated with the communication jack of FIG. 26, taken along the same section line as FIG. 27A.
Figure 28A:
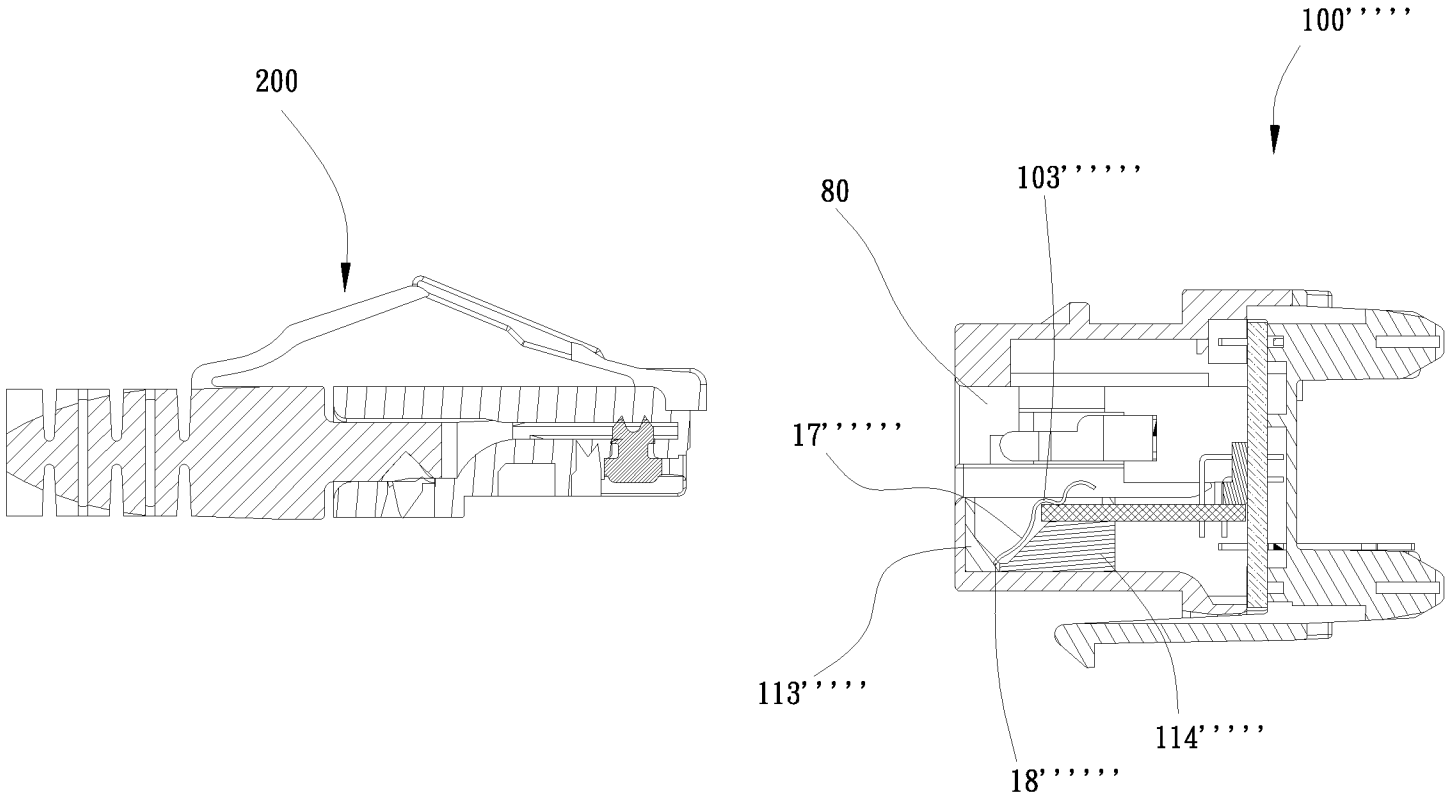
FIG. 28A is a side sectional view showing a communication plug aligned with the communication jack of FIG. 26, taken along a section line so as to view a spring contact of a second set of spring contacts.
Figure 28B:
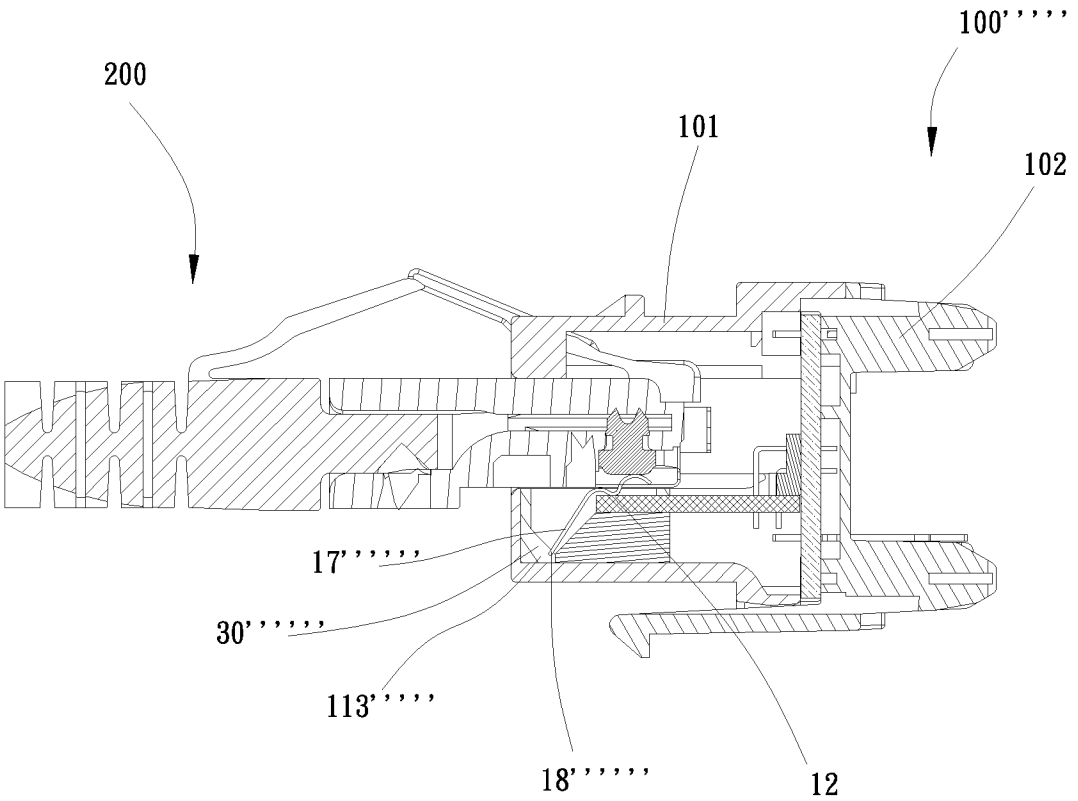
FIG. 28B is a side sectional view showing a communication plug mated with the communication jack of FIG. 26, taken along the same section line as FIG. 28A.
Figure 29A:
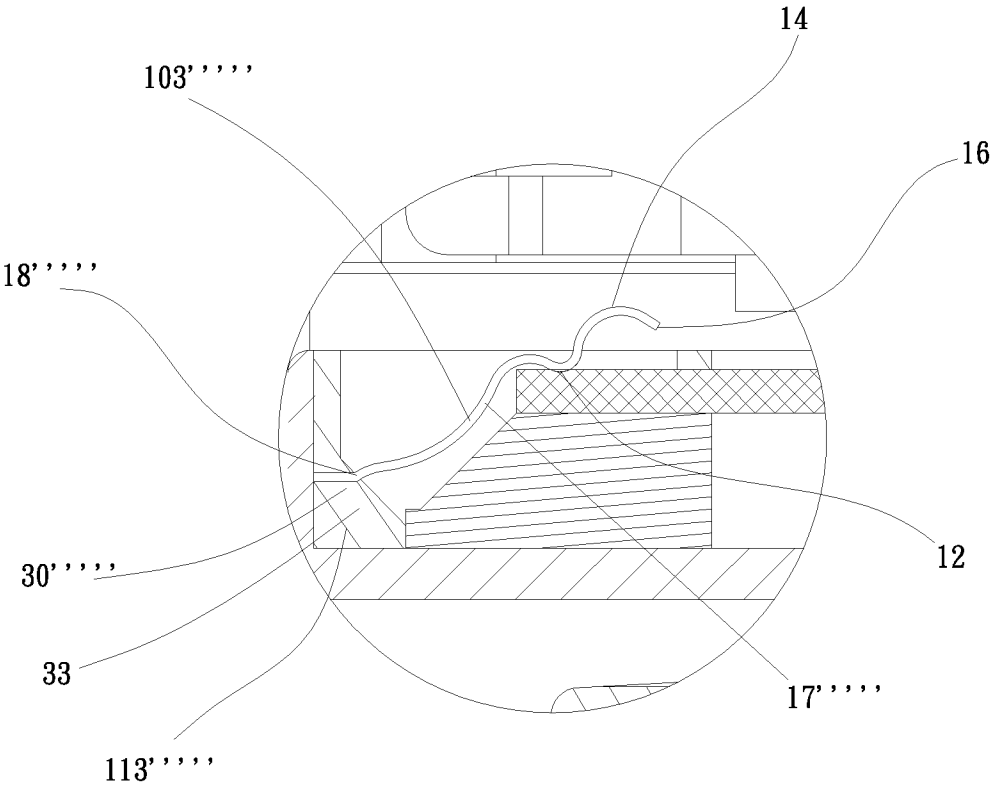
FIG. 29A is an enlarged side sectional view, corresponding to a portion of FIG. 27A, showing a portion of the plug receiving space, in an unmated state, of the communication jack of FIG. 26.
Figure 29B:
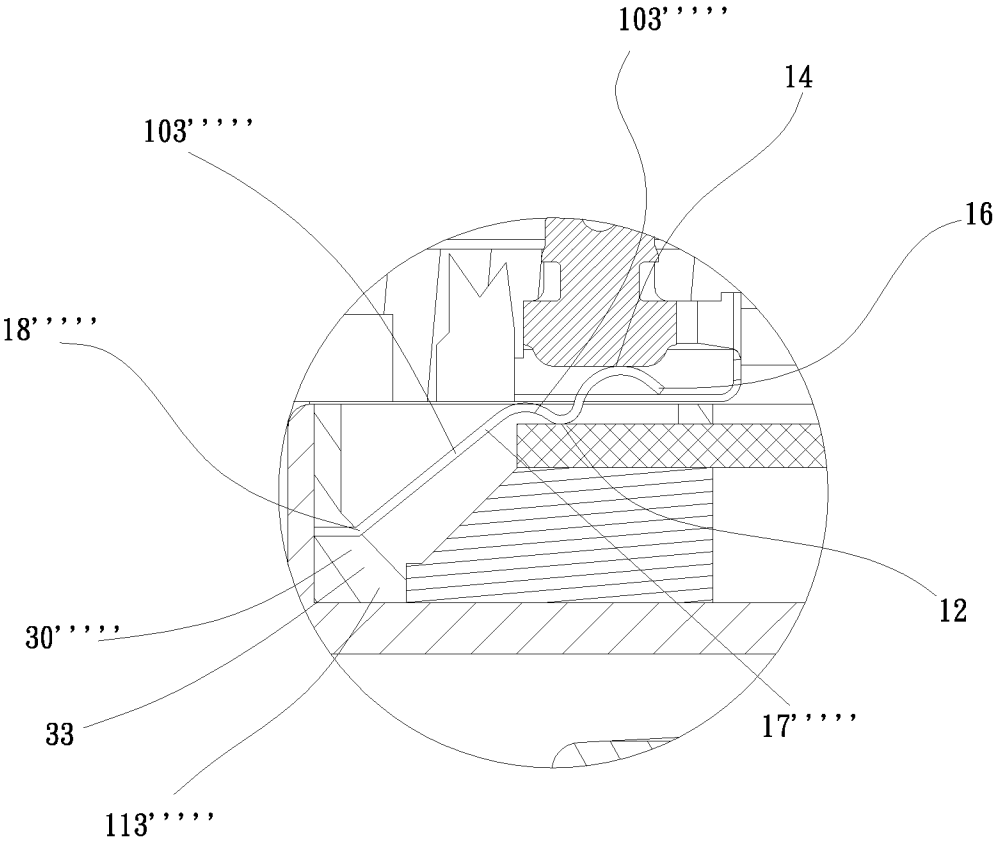
FIG. 29B is an enlarged side sectional view, corresponding to a portion of FIG. 27B showing a portion of the plug receiving space, in a mated state, of the communication jack of FIG. 26.
Figure 30A:
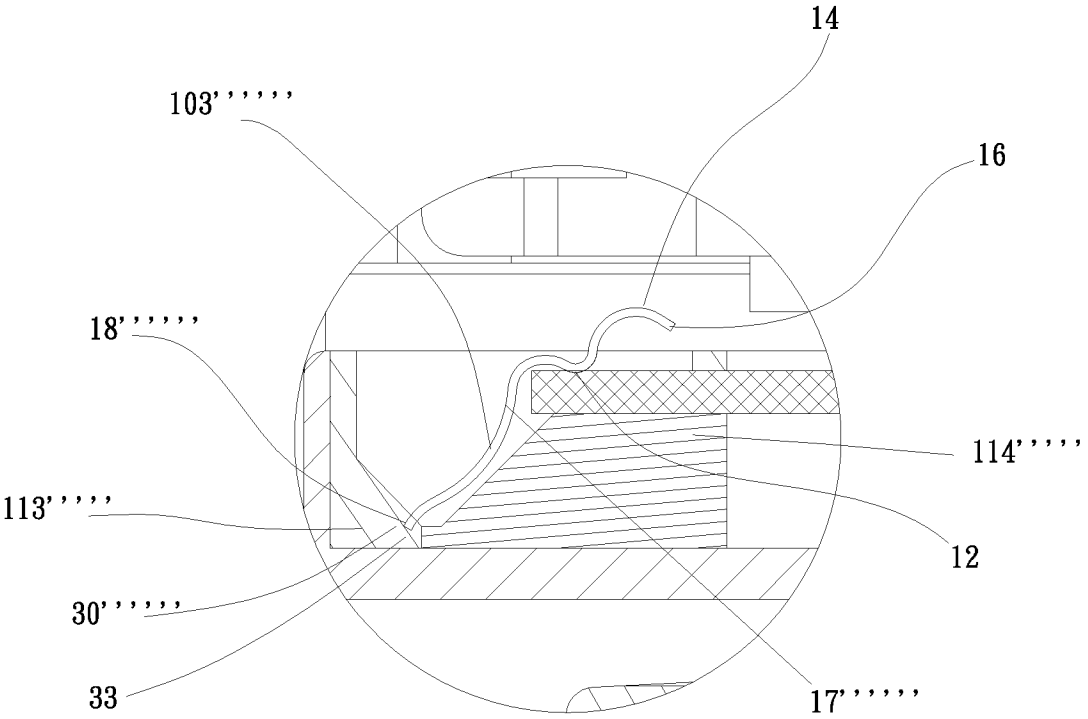
FIG. 30A is an enlarged side sectional view, corresponding to a portion of FIG. 28A, showing a portion of the plug receiving space, in an unmated state, of the communication jack of FIG. 26.
Figure 30B:
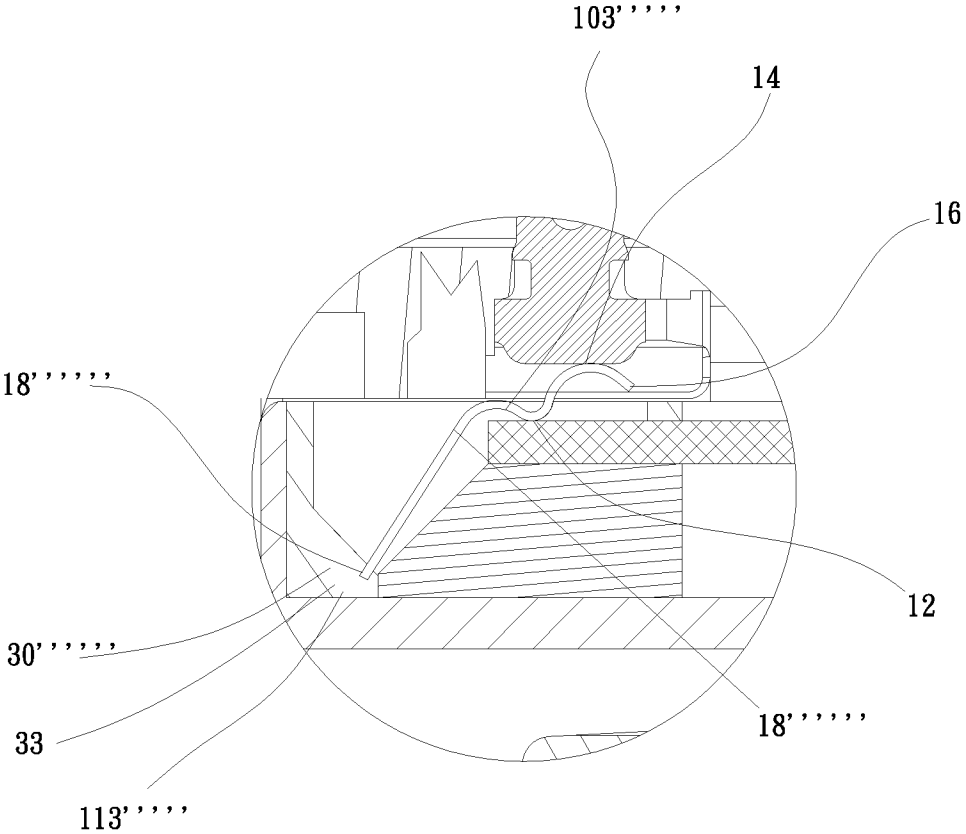
FIG. 30B is an enlarged side sectional view, corresponding to a portion of FIG. 28B showing a portion of the plug receiving space, in a mated state, of the communication jack of FIG. 26.
Figure 31:
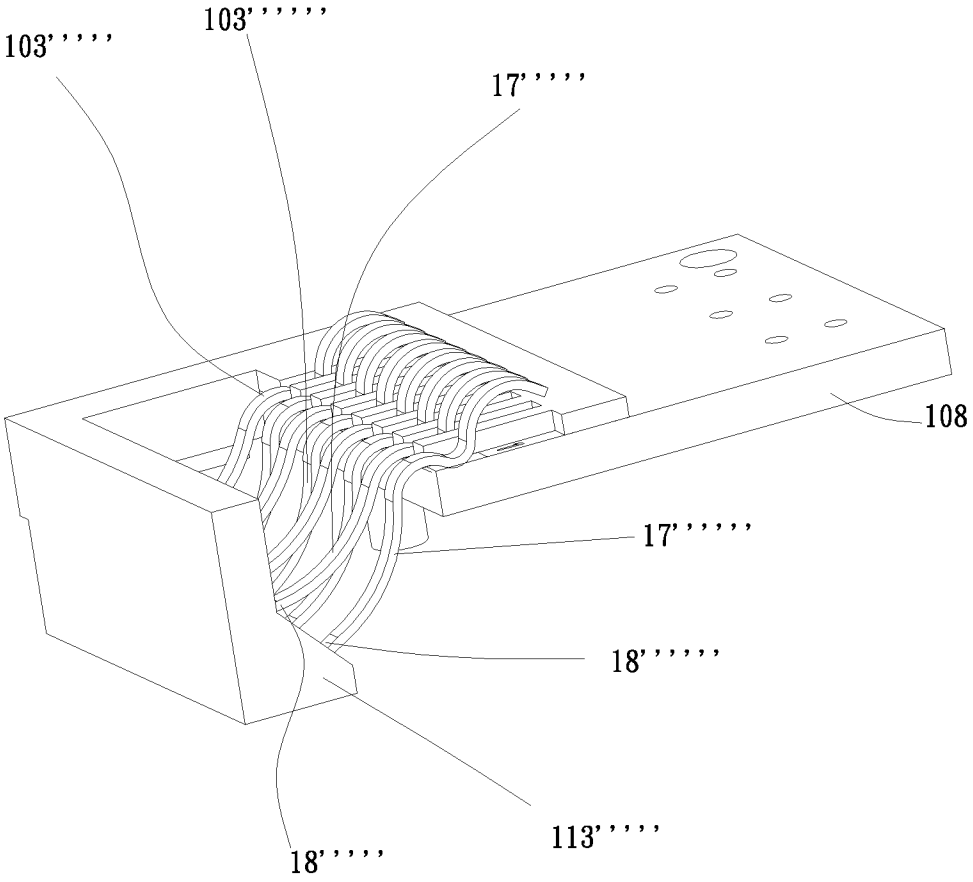
FIG. 31 is a side perspective sectional view showing a subassembly with a fitting portion, spring contacts, biasing springs, insulator holders and circuit board with pads of the communication jack of FIG. 26.

The spring contact arrangement 10"" is essentially the same as the spring contact arrangement 10'", with the exception that the spring contact arrangement 10"" includes spring contacts 103"" with contact portion 19"" with a greater stiffness than a remainder of the spring contact 103"". In particular, the contact portion 19"" has a greater stiffness and or a greater width and thickness than the spring arm 17"". As with the embodiment of FIGS. 19-21B, the first fitting portion or insert base 114"" cooperates with a second fitting portion that is unitary body portion of the housing part 101"". The spring contact arrangement 10"" supports spring contacts 103"". As with the embodiment of FIGS. 19-21B, instead of interacting with a retaining surface 40 of a retaining portion 26, the spring contacts 103"" are retained by retaining bar 29. The retaining bar 29 is a portion of the first fitting portion or insert base 114"". The first fitting portion 114"" and the second fitting portion of the housing part 101"" hold the spring contacts 103"" and position the spring contacts 103"", based on a spring contact guiding region 30"" that accommodates the spring contacts 103"" (FIGS. 24A and 24B). This provides support and a sliding guide for the end portion 18"" at the support and guide region 30"". The configuration again allows the spring contact 103"" to move or flex at each side of the contact of the pad contact portion 12 against the pads 111.

A sixth embodiment of a communication jack 100""" is shown in FIGS. 26-31. The communication jack 100""" includes features similar to the first embodiment of the communication jack 100 and the same reference numerals are used with regard to features which are essentially the same. However, the communication jack 100""" includes a different spring contact arrangement 10"".

The spring contact arrangement 10"" is formed of fitting portion 113"" and fitting portion 114"". The fitting portions 113"" and fitting portion 114"" are insert parts, but one or both may be a portion of a housing part, such as unitarily formed with the housing part 101. The fitting portion 113"" has a spring contact supporting/guiding region 30"" that supports spring contacts 103"" with each a supported/guided end portion 18"" being insert molded at insert molding (insert molded region) 33. The supporting/guiding region 30"" supports the spring contacts 103"" for guided flexing movement. The fitting portion 113"" has a spring contact supporting/guiding region 30"" that supports spring contacts 103"" with each a supported/guided end portion 18"" being insert molded at insert molding (insert molded region) 33. The supporting/guiding region 30"" supports the spring contacts 103"" for guided flexing movement.

The shape and course of the supported/guided portion 18"" diverges from the shape and course of the supported/guided portion 18"". This provides a configuration such that each supported/guided portion 18"" and the adjacent supported/guided portion 18"" are at different angles from each other and at different angles relative to the communication jack 100"". The fitting portion 113"" holds (positions, supports, guides) the spring contacts 103"" and 103"" based on a support/guiding region 30"" that is an insert molded connection of the fitting portion 113"" and the portion 18"" and based on support/guiding region 30"" that is an insert molded connection of the fitting portion 113"" and the portion 18"". The support/guide regions 30"", 30"" provide extending spring arm portions 17"" and 17"" that are not parallel. The spring arm portion 17"" and 17"" allow the associated pad contact portion 12 to bear on the associated pad 111. The contact arrangement 10"" positions each of the spring contacts 103"" and 103"" such that each plug contact surface 14 is positioned in the plug contact receiving space 80 of the communication jack 100"". The configuration provided by the spring contact arrangement 10"" allows the spring contact 103"" and 103"" to move or flex at each side of the pad contact portion 12, that contacts the pads 111. The configuration provides good flexural aspects for the spring contacts 103"" and 103"".

Although the examples show spring contact arrangements comprised of parts of an insert or comprised of housing parts and one or more insert parts, other variations are possible. The housing parts or portions of the circuit arrangement or any combination of portions of the circuit arrangement, portions of one or more housing parts and one or more insert parts may position, support, guide and retain the contacts 103-103"". In each case the plug contact surface 14 is positioned in the plug contact receiving space 80 in an unmated state and in a plug mated state a deflection of the contact portion 19, 19"", causes a relative deflection of the spring arm portion 17, 17', 17", 17"', 17"", 17""', 17""" with the supported/guided end or portion supported/guided portion 18-18"" guided and/or supported by the support and guide region 30, 30", 30"', 30"", 30""', 30""". Such a spring contact 103-103"" undergoes a rocking motion with the contact spring pivoting against the associated contact pad with a transitioning from the unmated state to plug mated state. This is particularly advantageous as the spring contacts 103-103"" are divided into functional parts with a contact portion 19, 19"", and another guided spring arm portion 17, 17', 17", 17"', 17"" 17"", 17""". With this, the contact 103-103"" have a very short contact length and transmission length, but the overall spring contact 103-103"" has good spring characteristics with a long flexible spring arm with good overall spring characteristics.

While specific embodiments of the invention have been shown and described in detail to illustrate the application of the principles of the invention, it will be understood that the invention may be embodied otherwise without departing from such principles.

LIST OF REFERENCE NUMBERS

10, 10', 10", 10"', 10"", 10""' spring contact arrangement—support arrangement
12 pad contact portion
14 plug contact surface
16 extending end
17, 17', 17", 17"', 17"" 17""' spring arm portion
18, 18', 18", 18"', 18"" 18""' supported/guided end portion
19, 19"" contact portion
20 second circuit board circuit traces/transmission paths
22 first circuit board circuit traces/transmission paths
24, 24' insert cover slots
26 retaining portion
29 retaining bar
30, 30", 30"', 30"" contact guiding/contact support region
32 inserted end
33 insert molding of ends
34 receiving passages
36 biasing spring arm
38 receiving slot
40 extending end retaining surface
70 IDC receiving plated through holes
60 plated through holes for circuit board connecting pins
65 plated through holes for circuit board connecting pins
80 plug receiving space
100, 100', 100"', 100"', 100"', 100""' communication jack
101, 101"', 101"" housing part
102 seat housing part
103, 103', 103", 103"', 103"" spring contacts
105 groundings spring
106 holder
107 IDC contacts
108 first circuit board
109 second circuit board
110 pin head
111 pads
112, 112' biasing spring
113, 113', 113", 113"', 113"" insert cover—second fitting portion
114, 114', 114" insert base—first fitting portion
120 plug opening

200 communication plug
203 plug contact
500 cable
502 wires

What is claimed is:

1. A communication connector jack comprising:

a housing defining a plug receiving space;

a circuit board arrangement supported by the housing, the circuit board arrangement comprising a plurality of electrical circuits defining plural pairs of communication paths and a plurality of contact pads, each of the contact pads being electrically connected to a respective one of the communication paths; and a spring contact arrangement comprising a support/guide and a plurality of spring contacts, each of the plurality of spring contacts having a supported/guided portion that is supported/guided by the support/guide and having an extending end, having an intervening pad contact portion, between the supported/guided portion and the extending end, each pad contact portion being in electrical and physical contact with an associated one of the contact pads of the circuit board arrangement, having a spring arm portion between the supported/guided portion and the pad contact portion and having a contact portion, with a plug contact surface, between the pad contact portion and the extending end, the plug contact surface being positioned in the plug contact receiving space in an unmated state and in a plug mated state a deflection of the contact portion causing a relative deflection of the spring arm portion, wherein a stiffness of the contact portion extending end and/or of the contact portion is greater than a stiffness of the spring arm portion.

2. The communication connector jack according to claim 1, wherein each contact spring undergoes a rocking motion with the contact spring pivoting against the associated contact pad with a transitioning from the unmated state to plug mated state.

3. The communication connector jack according to claim 1, wherein:

the support/guide is comprised by a first fitting portion and a second fitting portion; and the supported/guided portion extends between the first fitting portion and the second fitting portion and is guided between the first fitting portion and the second fitting portion at a fitting spring contact guiding region.

4. The communication connector jack according to claim 3, wherein the first fitting portion comprises an insert base and the second fitting portion comprises an insert cover with slots with each of the spring contacts extending through one of the slots to position the extending ends and the pad contact portion on a plug receiving space side of the insert cover.

5. The communication connector jack according to claim 4, wherein the insert cover includes a retaining portion extending from the insert cover in a direction of the plug receiving space, and the first fitting portion and the second fitting portion support the supported/guided portion with the pad contact portion in contact with one of the pads and with the extending end biased into contact with the retaining portion whereby upon a plug being inserted into the plug receiving space, the extending end is moved, by a contact of the plug, relative to the retaining portion and against the spring bias.

6. The communication connector jack according to claim 3, wherein the support/guide of the spring contact arrangement further comprises a plurality of holder arrangements, each holder arrangement comprising a biasing spring with a non-conductive holder forming a portion of the spring contact guiding region, wherein each biasing spring is held between the first fitting portion and said second fitting portion to press an associated holder into contact with an associated supported/guided portion of one of the contact springs to form said guiding region between the non-conductive holder and a non-conductive portion of one of said first fitting portion and said second fitting portion.

7. The communication connector jack according to claim 6, wherein the contact spring and the biasing spring together provide combined spring arm characteristics divided into a contact portion and a non conductive supporting portion.

8. The communication connector jack according to claim 3, wherein said plurality of spring contacts comprise:

a first set of spring contacts having a first set supported/guided portion, a first set pad contact portion and a first set spring arm portion between the supported/guided portion and pad contact portion, wherein each said first set spring arm portion and said first supported/guided portion extend essentially along a first angle of inclination relative to said first fitting portion and said second fitting portion; and a second set of spring contacts having a second set supported/guided portion, a second set pad contact portion and a second set spring arm portion between the supported/guided portion and pad contact portion, wherein each said second set spring arm portion and said second supported/guided portion extend essentially along a second angle of inclination relative to said first fitting portion and said second fitting portion and said first angle of inclination is different from said second angle of inclination and said contact springs are disposed one after another alternating between contact springs of said first set of contacts springs and contact springs of said second set of contacts springs, such that each spring arm portion is not parallel with an adjacent spring arm portion.

9. The communication connector jack according to claim 3, wherein the housing is formed of a plurality of housing parts; and at least one of the first fitting portion and a second fitting portion is formed in one piece with one of the housing parts.

10. The communication connector jack according to claim 3, wherein one of the first fitting portion and the second fitting portion includes a retaining bar to retain each spring contact in electrical and physical contact with an associated one of the contact pads.

11. The communication connector jack according to claim 1, wherein:

the support/guide is comprised by an insert molding of the supported/guided portions.

12. The communication connector jack according to claim 11, wherein said plurality of spring contacts comprise:

a first set of spring contacts having a first set insert molded supported/guided portion, a first set pad contact portion and a first set spring arm portion between the supported/guided portion and pad contact portion, wherein each said first set spring arm portion and said first supported/guided portion extend essentially along a first angle of inclination relative to said first fitting portion and said second fitting portion; and a second set of spring contacts having a second set insert molded supported/guided portion, a second set pad contact portion and a second set spring arm portion between the supported/guided portion and pad contact portion, wherein each said second set spring arm portion and said second supported/guided portion extend essentially along a second angle of inclination relative to said first fitting portion and said second fitting portion and said first angle of inclination is different from said second angle of inclination and said contact springs are disposed one after another alternating between contact springs of said first set of contacts springs and contact springs of said second set of contacts springs, such that each spring arm portion is not parallel with an adjacent spring arm portion.

13. The communication connector jack according to claim 12, wherein insert molding of each first set insert molded supported/guided portion is offset relative to insert molding of each second set insert molded supported/guided portion.

14. The communication connector according to claim 1, wherein the connector is a RJ45 socket.

15. The communication connector according to claim 1, further comprising insulation displacement contacts (IDCs) electrically connected to a respective one of the communication paths, wherein:

the circuit arrangement comprises at least one circuit board;

the IDCs are each connectable to a respective wire of a cable;

the IDCs are each connected to the at least one circuit board such that the communication paths run between the respective IDCs and the pads;

the housing defines a RJ plug opening for receiving a RJ jack in the plug receiving space.

16. A communication connector jack comprising:

a housing defining a plug receiving space;

a circuit board arrangement supported by the housing, the circuit board arrangement comprising a plurality of electrical circuits defining plural pairs of communication paths and a plurality of contact pads, each of the contact pads being electrically connected to a respective one of the communication paths; and a spring contact arrangement comprising a support/guide and a plurality of spring contacts, each of the plurality of spring contacts having a supported/guided portion that is supported/guided by the support/guide and having an extending end, having an intervening pad contact portion, between the supported/guided portion and the extending end, each pad contact portion being in electrical and physical contact with an associated one of the contact pads of the circuit board arrangement, having a spring arm portion between the supported/guided portion and the pad contact portion and having a contact portion, with a plug contact surface, between the pad contact portion and the extending end, the plug contact surface being positioned in the plug contact receiving space in an unmated state and in a plug mated state a deflection of the contact portion causing a relative deflection of the spring arm portion, wherein:

the support/guide is comprised by a first fitting portion and a second fitting portion;

the supported/guided portion extends between the first fitting portion and the second fitting portion and is guided between the first fitting portion and the second fitting portion at a fitting spring contact guiding region;

the housing is formed of a plurality of housing parts; and at least one of the first fitting portion and a second fitting portion is formed in one piece with one of the housing parts.

17. A communication connector jack comprising:

a housing defining a plug receiving space;

a circuit board arrangement supported by the housing, the circuit board arrangement comprising a plurality of electrical circuits defining plural pairs of communication paths and a plurality of contact pads, each of the contact pads being electrically connected to a respective one of the communication paths; and a spring contact arrangement comprising a support/guide and a plurality of spring contacts, each of the plurality of spring contacts having a supported/guided portion that is supported/guided by the support/guide and having an extending end, having an intervening pad contact portion, between the supported/guided portion and the extending end, each pad contact portion being in electrical and physical contact with an associated one of the contact pads of the circuit board arrangement, having a spring arm portion between the supported/guided portion and the pad contact portion and having a contact portion, with a plug contact surface, between the pad contact portion and the extending end, the plug contact surface being positioned in the plug contact receiving space in an unmated state and in a plug mated state a deflection of the contact portion causing a relative deflection of the spring arm portion, wherein:

the support/guide of the spring contact arrangement further comprises a plurality of holder arrangements, each holder arrangement comprising a biasing spring with a non-conductive holder forming a portion of the spring contact guiding region, wherein each biasing spring is held between the first fitting portion and said second fitting portion to press an associated holder into contact with an associated supported/guided portion of one of the contact springs to form said guiding region between the non-conductive holder and a non-conductive portion of one of said first fitting portion and said second fitting portion.

* * * * *